US005481338A

United States Patent [19]

Todome

[11] Patent Number: 5,481,338

[45] Date of Patent: Jan. 2, 1996

[54] IMAGE FORMING APPARATUS FOR FORMING AN IMAGE ON AN IMAGE RECEIVING MEDIUM CARRIED BY A CONVEYOR BELT

[75] Inventor: Tuyoshi Todome, Kanagawa, Japan

[73] Assignee: Kabushiki Kaisha Toshiba, Kawasaki, Japan

[21] Appl. No.: 205,851

[22] Filed: Mar. 4, 1994

[30] Foreign Application Priority Data

| | | | |
|---|---|---|---|
| Mar. 5, 1993 | [JP] | Japan | 5-045014 |
| Mar. 25, 1993 | [JP] | Japan | 5-066304 |
| Mar. 25, 1993 | [JP] | Japan | 5-067097 |

[51] Int. Cl.[6] ..... G03G 5/00

[52] U.S. Cl. ..... 355/212; 198/806; 474/101

[58] Field of Search ..... 355/211–213, 271, 355/275; 474/101, 102, 104, 106; 198/785, 786, 806, 807, 814

[56] References Cited

U.S. PATENT DOCUMENTS

| | | | |
|---|---|---|---|
| 4,174,171 | 11/1979 | Hamaker et al. | 198/806 X |
| 4,547,059 | 10/1985 | Nagayama et al. | 198/806 X |
| 4,627,702 | 12/1986 | Anderson | 355/212 |
| 4,961,089 | 10/1990 | Jamzadeh | 355/212 X |
| 5,078,263 | 1/1992 | Thompson et al. | 198/807 |
| 5,164,777 | 11/1992 | Agarwal et al. | 355/212 |
| 5,172,175 | 12/1992 | Sekino et al. | 355/277 |
| 5,248,027 | 9/1993 | Kluger et al. | 198/807 X |

OTHER PUBLICATIONS

Patent Abstracts of Japan, vol. 13, No. 215 (P–874) May 19, 1989.

Patent Abstracts of Japan, vol. 13, No. 566 (P–976) Dec. 15, 1989.

European Search Report.

*Primary Examiner*—William J. Royer

*Attorney, Agent, or Firm*—Foley & Lardner

[57] ABSTRACT

An image forming apparatus includes a plurality of image carriers on each of which an image is formed, a conveyor belt for carrying an image receiving medium, a driving roller on which the conveyor belt is mounted for driving the conveyor belt to convey the image receiving medium and a pressing roller for pressing the conveyor belt against the driving roller. The images formed on the image carriers are transferred seguentially to the image receiving medium conveyed by the conveyor belt. A tensioning member causes the conveyor belt to skid to maintain proper relative positioning of the components.

5 Claims, 27 Drawing Sheets

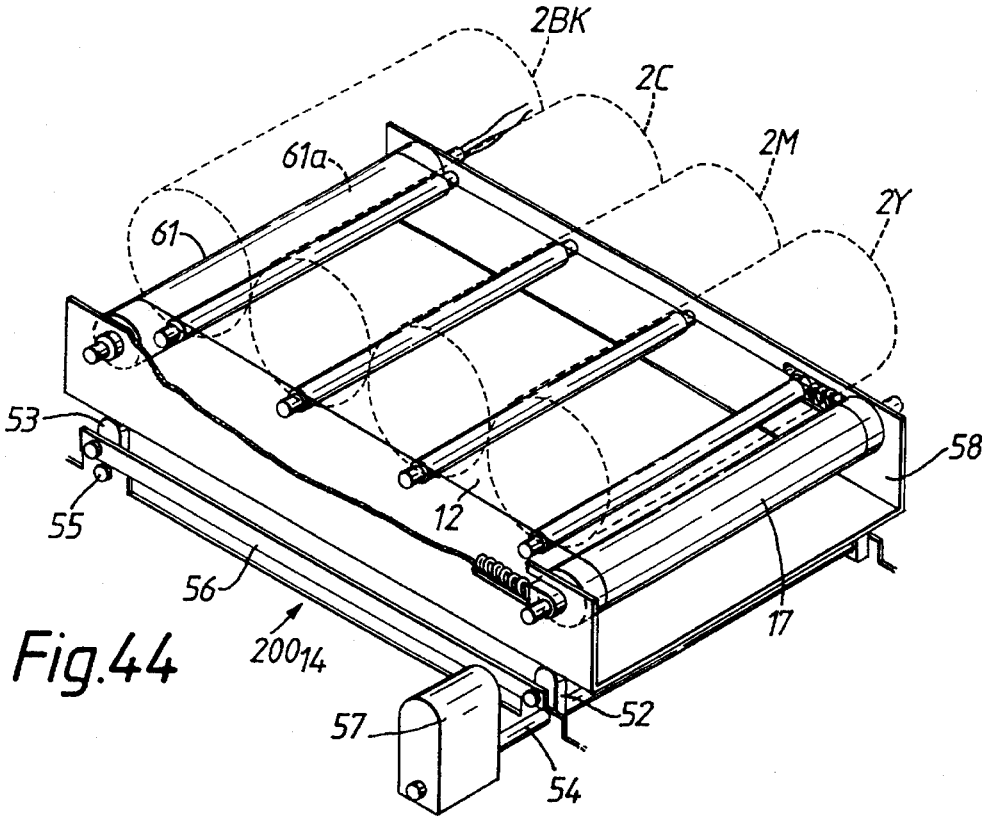
Fig.44
Fig.46
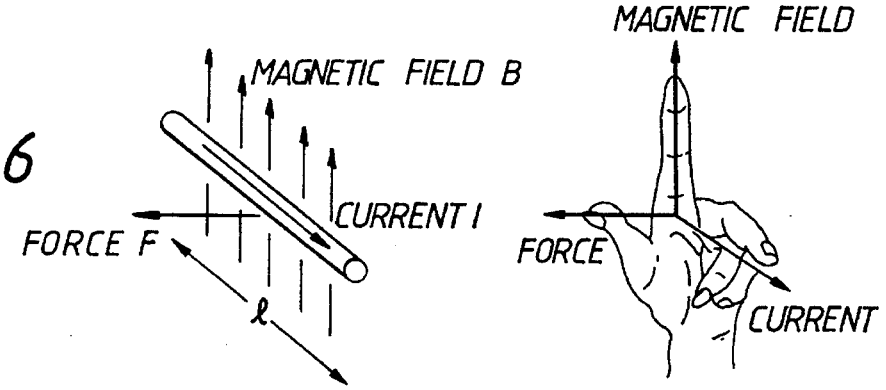
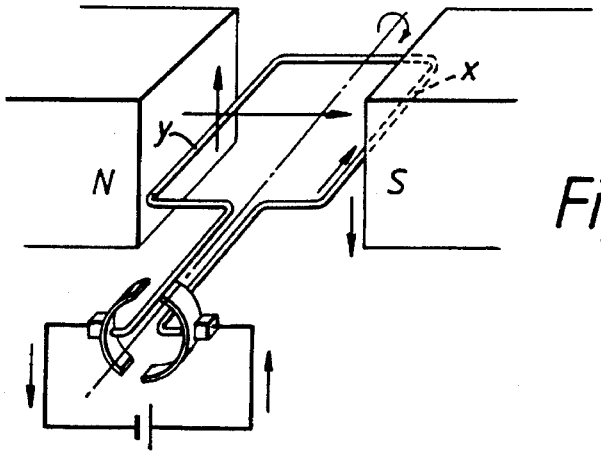
Fig.47

IMAGE FORMING APPARATUS FOR FORMING AN IMAGE ON AN IMAGE RECEIVING MEDIUM CARRIED BY A CONVEYOR BELT

BACKGROUND OF THE INVENTION

1. Field of the Invention

The present invention relates to image forming apparatus which form images on an image receiving medium using a plurality of photosensitive drums such as a color copying machine, etc.

2. Description of the Related Art

There is a color copying machine comprising four photosensitive drums arranged parallelly. In this type of copying machine, four photosensitive drums are arranged parallelly and toner images in different colors are formed on the respective photosensitive drums using yellow, magenta, cyanic and black toners. Each of these toner images is transferred and formed on a single sheet of paper.

In the color copying machine using these four photosensitive drums, an image receiving medium placed on a conveyor belt is brought in contact with the four photosensitive drums one by one and respective toner images are transferred from the drums onto the image receiving medium.

Further, when forming an image other than color images, for instance, forming a black image only, no toner image is formed on the yellow, magenta and cyanic drums and a black toner image is formed and transferred onto an image receiving medium. Thus, an image only in black is obtained.

However, a conveyor belt is normally wound around driving rollers comprising rubber rollers and is moved by rotating the driving rollers. The largest reason for using rubber rollers is to prevent the conveyor belt from slipping against the driving rollers by making the coefficient of statical friction of the rubber rollers with the conveyor belt large.

Because, if the conveyor belt slips against the driving rollers, the moving distances of copying papers being conveyed by the conveyor belt changes, causing a color shift on the image receiving medium in the conveying direction. That is, in order to prevent the conveyor belt from slipping against the driving rollers, it is desirable to use soft rubber rollers with hardness of rubber lowered.

However, if a rubber roller is used, accuracy of the outer diameter of the driving roller drops and the more soft a rubber roller is, more worse the accuracy of the outer diameter of the driving roller will become. If accuracy of the outer diameter of the driving roller drops, the peripheral speed of the roller changes, making the conveying speed of the conveyor belt irregular and finally, a color shift is caused on copying papers in the conveying direction.

When a conveyor belt is used for a long time, its surface becomes dirty as toners and paper powder of the image receiving medium attach thereon and therefore, the conveyor belt is cleaned with a belt cleaning device. However, this conveyor belt cleaning device cleans a belt by bringing a rubber blade in contact with the surface of the conveyor belt and a material having a high contact resistance against a rubber blade is used as the conveyor belt. Therefore, when a conveyor belt is rubbed by a rubber blade of a belt cleaning device which is kept in contact with the conveyor belt, electric charge is left. Unless this residual electric charge is neutralized the residual potential of the conveyor belt becomes high and images are not satisfactorily transferred on the image receiving medium. Furthermore, a problem is also caused that ozone is generated if a corona discharger is used to neutralize the residual electric charge.

In this type of image forming apparatus, there was a problem that the conveying speed of a conveyor belt becomes irregular as its peripheral speed changes if the accuracy of the outer diameter of driving rollers drop and as a result, a color shift of images on an image receiving medium may be caused along the conveying direction of the image receiving medium.

Further, as described above, the image receiving medium is conveyed toward four photosensitive drums by a conveyor belt. However, if the conveyor belt is moved while meandering unwillingly, the image receiving medium is also conveyed while meandering correspondingly and there was a problem that the same images in different colors will be shifted as the images in different colors are transferred sequentially on the image receiving medium as a result of the meandering conveyance.

In order to solve this problem, a regulation plate is provided at both ends of the rollers over which a conveyor belt is put as disclosed in the Japanese Utility Model Laid-open Publication (JITSU-KAI-HEI) 4-7543. The conveyor belt is moved while keeping its both ends in contact with these regulation plates to prevent the conveyor belt from meandering.

In this construction, however, if a distance between two regulation plates provided at the rollers is not in accord with the width of a conveyor belt, a problem described below will be caused. That is, there will be a problem that at a place where the distance between two control plates is wide, it is possible for the conveyor belt to meander and at a place where the distance between two control plates is narrow, the conveyor belt may possibly run over one of the regulation plates and as a result, a color shift will be caused on images on the image receiving medium along the direction perpendicular to the conveying direction of the image receiving medium.

Further, in a conventional image forming apparatus, the rollers are rotated by transmitting the turning force of a motor to one of the rollers having parallel shafts over which a conveyor belt is put and a conveying force is provided by moving the conveyor belt in the rotating direction of the rollers. There was a problem that if the moving speed of the conveyor belt becomes irregular, it is not possible to transfer images from four photosensitive drums at a prescribed position and as a result, a color shift is caused on images on the image receiving medium. In view of this problem, construction to use driving rollers directly as the rotary shaft of a motor without using driving transmission gears, etc. which may cause irregular moving speed of a conveyor belt. That is, a driving roller and a motor are in one united body. There are a belt cleaner, photosensitive drums, image transfer rollers, etc. arranged while kept in contact with this conveyor belt along its surface. These arrangements, however, will become loads when driving the conveyor belt. Further, when processing jammed image receiving medium, the conveyor belt is separated from the state in contact with the photosensitive drums and pulled out of the body of the apparatus. Because of this construction, in order to pull out the conveyor belt easily it is necessary to lower the belt to a location where the motor does not come in contact with the photosensitive drums.

On the other hand, in order to drive a conveyor belt while overcoming loads, a motor needs a large torque. Generally, a motor large in size is used to improve its torque. However, because a roller and a motor for driving the conveyor belt are in one united body as described above, if a large motor is used, it becomes necessary to further lower the conveyor belt to prevent the photosensitive drums and the motor from contacting each other when processing jammed image receiving medium. Thus, there comes out a problem that the entire image forming apparatus will become large in size.

SUMMARY OF THE INVENTION

It is one of the objects of the present invention to provide an image forming apparatus which does not cause a color shift of images along the conveying direction of an image receiving medium.

Another object of the present invention is to provide an image forming apparatus which does not become large in size even when a motor generating a large torque is used for driving rollers over which a conveyor belt is put.

A further object of the present invention is to provide an image forming apparatus which does not cause a color shift of images along the direction perpendicular to the conveying direction of an image receiving medium.

According to the present invention, there is provided an image forming apparatus comprising means for forming images on a plurality of image carriers, a conveyor belt for carrying an image receiving medium, a driving roller on which the conveyor belt is mounted for driving the conveyor belt to convey the image receiving medium, a pressing roller for pressing the conveyor belt against the driving roller, and means for transferring the images from the image carriers to the image receiving medium conveyed by the conveyor belt.

Further, according to the present invention, there is provided an image forming apparatus comprising means for forming images on a plurality of image carriers, a conveyor belt for carrying an image receiving medium, a plurality of rollers on which the conveyor belt is mounted for moving the conveyor belt to convey the image receiving medium sequentially to the image carriers, an outer rotor type motor having a rotated outer housing provided to one of the rollers for driving the conveyor belt to move the conveyor belt by a friction of the rotated outer housing with the conveyor belt, and means for transferring the images from the image carriers to the image receiving medium conveyed by the conveyor belt.

Yet further, according to the present inventions, there is provided an image forming apparatus comprising means for forming images on a plurality of image carriers; a conveyor belt having a first peripheral edge and a second peripheral edge opposing to the first peripheral edge for carrying an image receiving medium, the conveyor belt having a first length L1 at the first peripetal edge and a second length L2 at the second peripheral edge shorter than the first length L1; a plurality of rollers on which the conveyor belt is mounted for moving the conveyor belt to convey the image receiving medium sequentially to the image carriers; a tensioning means for giving a tension to the conveyor belt so as to skid the conveyor belt toward the second peripheral edge when the conveyor belt is moved by the rolleres; a regulation member for regulating the skid of the conveyor belt; and means for transferring the images from the image carriers to the image receiving medium conveyed by the conveyor belt.

Still further, according to the present invention, there is provided an image forming apparatus comprising means for forming images on a plurality of image carriers, a conveyor belt for carrying an image receiving medium, a plurality of rollers on which the conveyor belt is mounted for moving the conveyor belt to convey the image receiving medium sequentially to the image carriers, the rollers including at least one tensioning roller having a contact surface non-parallel to a remaining roller for giving a tension to the conveyor belt so as to skid the conveyor belt toward one end of the rollers when the conveyor belt is moved, a regulation member for regulating the skid of the conveyor belt, and means for transferring the images from the image carriers to the image receiving medium conveyed by the conveyor belt.

BRIEF DESCRIPTION OF THE DRAWINGS

FIG. 44 is a perspective view showing the construction of the conveyor belt unit of the full-color image forming apparatus shown in FIG. 43;

FIG. 46 is an explanatory diagram showing Fleming's left hand rule;

FIG. 47 is an explanatory diagram showing the principle of operation of a DC motor;

DETAILED DESCRIPTION OF THE PREFERRED EMBODIMENTS

Hereinafter, the preferred embodiments of the present invention will be described in detail with reference to the drawings.

A first embodiment will be described with reference to FIGS. 1 through 3.

Figure 1:
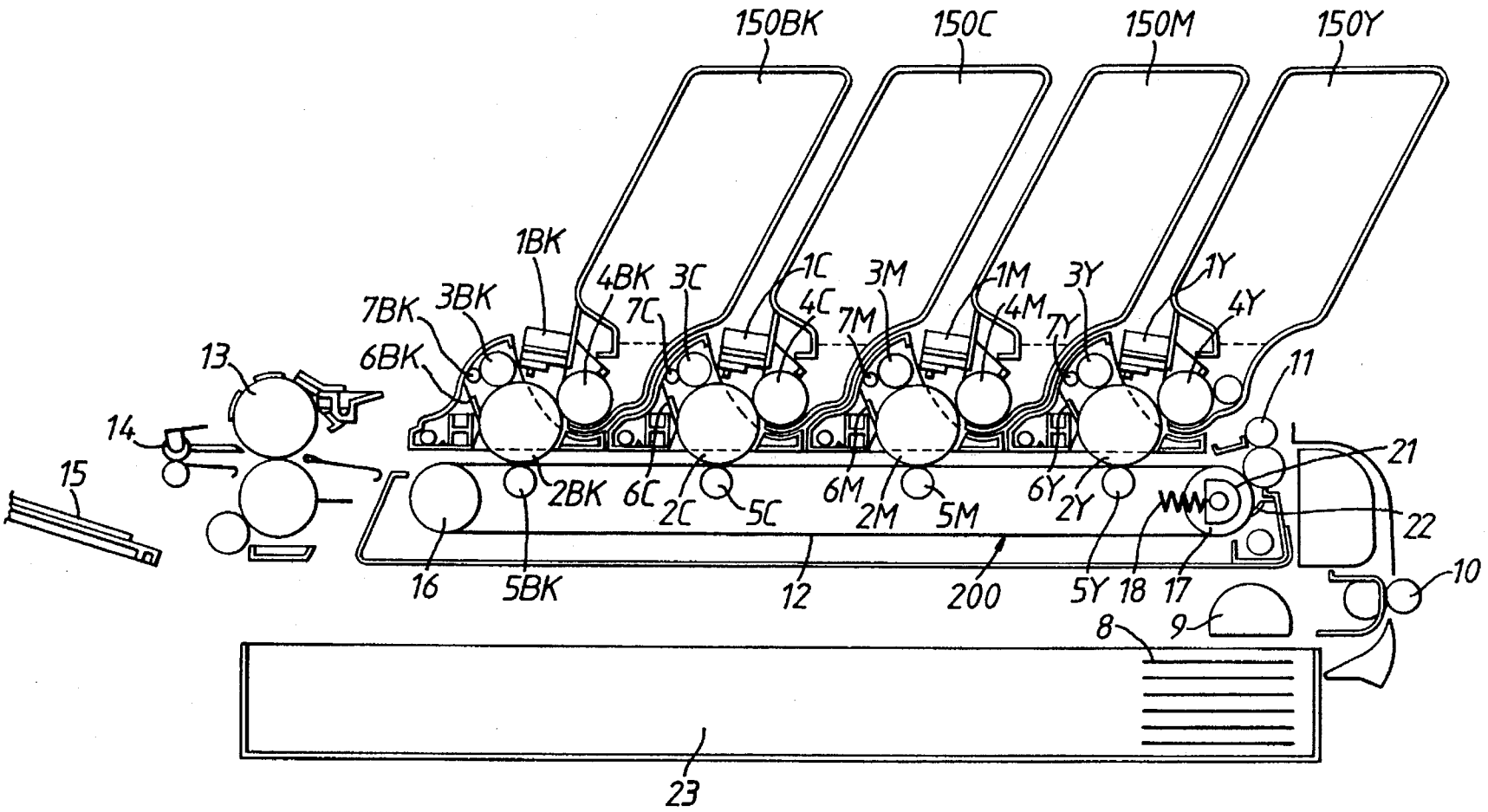
FIG. 1 is an outline diagram of full color image forming apparatus according to the present invention applied.

FIG. 1 shows the outline of the construction of a color copying machine as an image forming apparatus. In this color copying machine, four photosensitive drums 2Y, 2M, 2C and 2BK are arranged parallelly in this order as image carriers. Above these photosensitive drums, there are four image forming units 150Y, 150M, 150C and 150BK provided correspondingly for forming images on the respective photosensitive drums. Under these photosensitive drums there is a conveying means 200 provided for conveying an image receiving mediums 8, e.g. a sheet of paper, to the photosensitive drums 2Y, 2M, 2C and 2BK. Transfer rollers 5Y, 5M, 5C and 5BK are arranged corresponding to the photosensitive drums 2Y, 2M, 2C and 2BK as image transfer means for transferring toner images formed on the photosensitive drums onto image receiving medium 8 conveyed by the conveying means 200.

Four sets of the image forming units 150Y, 150M, 150C and 150BK are composed of a recording unit comprising charging devices 3Y, 3M, 3C and 3BK, solid scanning heads 1Y, 1M, 1C and 1BK, developing devices 4Y, 4M, 4C and 4BK, cleaning devices 6Y, 6M, 6C and 6BK and discharging devices 7Y, 7M, 7C and 7BK respectively.

Now, a yellow image forming unit 150Y will be described. The solid scanning head 1Y outputs exposure light to the photosensitive drum 2Y according to yellow image data being sent from a printing controller (not shown). The solid scanning head 1Y is in such a construction that it has very small light emitting sections arranged at equal spaces in the direction of the axis of rotation of the photosensitive drum 2Y, that is, on the line in the main scanning direction.

Lighting of the individual light emitting sections on the line of the main scanning direction is controlled according to the on-off signals sent from a printing controller according to a pattern to be printed. A light image is exposed on the photosensitive drum 2Y corresponding to an original image from the light emitting sections on one for one basis. An LED head array of resolution 400 DPI was used for the solid scanning head 1Y.

The charging device 3Y which charges the surface of the photosensitive drum 2Y, the developer device 4Y, the transfer device 5Y, the cleaning device 6Y and the discharging device 7Y are sequentially arranged around the photosensitive drum 2Y.

The photosensitive drum 2Y is rotated and driven by a driving motor (not shown). The surface of the photosensitive drum 2Y is charged by the charging device 3Y which is composed of a conductive charging roller and provided in contact with the surface of the photosensitive drum 2Y. Further, the charging roller is rotating when kept in contact with the surface of the photosensitive drum 2Y.

The surface of the photosensitive drum 2Y is formed by an organic photoconductor. Normally, this photoconductor has a high resistance but has a nature to change specific resistance of a lighted portion when light is applied. When light is applied to the charged surface of the photosensitive drum 2Y from the solid scanning head 1Y corresponding to a yellow print pattern, an electrostatic latent image of the yellow image pattern is formed on the surface of the photosensitive drum 2Y.

The electrostatic latent image is a so-called negative latent image that is formed on the surface of the photosensitive drum 2Y through charging when specific resistance of the lighted surface of a photoconductor is dropped by the light applied from the solid scanning head 1Y to discharge electric charge on the surface of the photosensitive drum 2Y and on the other hand, electric charge of the portion to which no light was applied remains.

Thus, the light from the solid scanning head 1Y forms an image at an exposing positional location on the charged photosensitive drum 2Y and the photosensitive drum 2Y with a latent image formed rotates to a developing position. Then, the latent image on the photosensitive drum 2Y is turned to a toner image as a visible image, by the developing device 4Y.

The developing device 4Y contains a yellow toner containing a yellow dye formed of resin. This yellow toner is frictionally charged when stirred in the developing device 4Y and has an electric charge of the same polarity as that charged on the photosensitive drum 2Y. When the surface of the photosensitive drum 2Y passes through the developing device 4Y, the yellow toner is adhered electrostatically to the discharged latent image portion only and this latent image is developed by the yellow toner.

The photosensitive drum 2Y with the yellow toner image formed on it is rotating continuously and the yellow toner image is transferred onto the image receiving medium 8 on the conveyor belt 12, that is timely fed by the transfer device 5Y which is in the transfer position. The conveyor belt 12 is mounted on driving roller 16 and the driven roller 17. The driven roller 17 is held by the driven roller holder 21.

A paper supply means is composed of a pickup roller 9, a feed roller 10 and a register roller 11. The image receiving medium 8 taken out of a paper supply cassette 23 by the pickup roller 9 is conveyed to the register roller 11 by one sheet only by the feed roller 10. The register roller 11 feeds the image receiving medium 8 after properly correcting its position. The peripheral velocity of the register roller 11 and that of the conveyor belt 12 have been so set that they become equal to the peripheral velocity V0 of the photosensitive drum 2Y. The image receiving medium 8 is conveyed to the transfer position of the photosensitive drum 2Y together with the conveyor belt 12 at a predetermined velocity equal to that of the photosensitive drum 2Y while being partially kept by the resister roller 11.

The yellow toner image on the photosensitive drum 2Y which is kept in contact with the image receiving medium 8 is removed from the photosensitive drum 2Y and transferred onto the image receiving medium 8 by the transfer device 5Y. As a result, the yellow toner image in a print pattern based on a yellow print signal is formed on the image receiving medium 8.

The transfer device 5Y is composed of a semiconductive transfer roller. This transfer roller 5Y supplies an electric field having the polarity reverse to a potential of the yellow toner adhered statically to the photosensitive drum 2Y through the back side of the conveyor belt 12. This electric field acts on the yellow toner image on the photosensitive drum 2Y through the image receiving medium 8 and as a result, the yellow toner image is transferred onto the image receiving medium 8 from the photosensitive drum 2Y.

The image receiving medium 8 with the yellow toner image thus transferred is conveyed sequentially to a magenta image forming unit 150M, a cyanic image forming unit 150C and further to a black image forming unit 150BK.

Further, the magenta image forming unit 150M, the cyanic image forming unit 150C and the black image forming unit 150BK contain a magenta (M), cyanic (C) and black (BK) color developers, respectively, instead of a yellow (Y) developer contained in a developing device 4Y for the yellow image forming unit 150Y. As these image forming units are constructed from the same components and their operations are all the same, the explanations of these image forming units will be omitted to make the explanation simple.

Now, the image receiving medium 8 with color images formed one over another while passing through the yellow, magenta, cyanic and black transfer positions is conveyed to a fixing device 13.

The fixing device 13 is composed of a heat roller with a heater incorporated therein which fixes the toner images in various colors on the image receiving medium 8 permanently by heating and fusing the color toners. The image receiving medium 8 with the fixed image is ejected on a receiving tray 15 by the exit roller 14.

On the other hand, the photosensitive drums 2Y, 2C and 2BK in respective colors passed through the transfer positions are driven and cleaned by cleaning devices 6Y, 6M, 6C and 6BK to remove residual toners and paper powder on the drums. Further, the potentials on the surfaces of the photosensitive drums 2Y, 2M, 2C and 2BK are regulated to a certain level. Then, a series of image forming processes from the charging devices 3Y, 3M, 3C and 3BK will begin.

After conveying the image receiving medium 8 to the fixing device 13, the conveyor belt 12 is cleaned by a cleaning device 22 to remove residual toners and paper powder adhered to the surface of the belt and conveys the next image receiving medium 8 when required.

Further, in the case of a unicolor print, the image forming by an image forming unit in a desired unicolor is carried out. At this time, other image forming units in colors other than the selected color do not perform their operations.

Next, a conveying means $\mathbf{200_1}$ in the first embodiment will be explained with reference to FIGS. 2 and 3.

The conveying means $\mathbf{200_1}$ is composed of an endless conveyor belt $\mathbf{12_1}$ which is put and extended over a parallelly provided driving roller $\mathbf{16_1}$ and a driven roller $\mathbf{17_1}$ with the middle section stretched opposing to the photosensitive drums 2Y, 2M, 2C and 2BK.

The driven roller $\mathbf{17_1}$ is pressed by a compression spring 18 (see FIG. 1), giving a tensile force to a conveyor belt $\mathbf{12_1}$.

The conveyor belt $12_1$ is an endless type and is retained by the driving roller $16_1$ at the fixing device 13 side and the driven roller $17_1$ at the image receiving medium supply side. The driving roller $16_1$ is given its driving force from a driving motor (not shown) and is driven so that a prescribed peripheral velocity of the photosensitive drum becomes equal to that of the belt.

On the other hand, the driven roller $17_1$ has a mechanism at both sides of the roller, which makes the roller movable in the direction parallel to the image receiving medium conveying direction. That is, the driven roller $17_1$ is pressed in the direction opposite to the image receiving medium conveying direction by the compression spring 18 to give a tensile force to the conveyor belt $12_1$. The mechanism of the driven roller $17_1$ which makes it possible to move in the direction parallel to the image receiving medium conveying direction is composed of a slot (not shown) provided on the frame and a driven roller holder (not shown) which slides in the slot and makes the driven roller $17_1$ rotatable.

The driving roller $16_1$ uses a roller with urethane rubber having a radial thickness of 1 mm baked to a metallic roller. The reason for using rubber on the surface is to prevent the conveyor belt $12_1$ from slipping on the driving roller $16_1$. As described above, the image receiving medium 8 is conveyed to four photosensitive drums 2Y, 2M, 2C and 2BK by the conveyor belt $12_1$ and images on the respective drums are transferred onto the image receiving medium 8. As the image receiving medium 8 is moved by the same distance as the conveyor belt $12_1$, if a slip is caused between the conveyor belt $12_1$ and the driving roller $16_1$, the image receiving medium 8 is forced to stay in a delayed position from a position where it is originally to be. This will cause the color shift on the images transferred one over another on the image receiving medium 8.

The use of the rubber type driving roller $16_1$ increases a coefficient of static friction with the conveyor belt $12_1$. To further increase its reliability, it is only necessary to increase the static friction coefficient. That is, it is needed to make a rubber soft and increase its thickness.

Further, it is needed to increase a contact pressure to the driving roller $16_1$ by increasing a tensile force of the conveyor belt $12_1$. However, when a rubber is made soft and its thickness is increased, manufacturing accuracy of the roller drops. As described previously, the image receiving medium 8 is conveyed by the conveyor belt $12_1$. If accuracy of the outer diameter of the driving roller $16_1$ is bad, a difference will be caused in the peripheral velocity of the conveyor belt $12_1$ and that of the peripheral surface of the driving roller $16_1$ according to which the belt is moved.

That is, coarse accuracy of the outer diameter of the driving roller $16_1$ means that a radial size at a first position in the axial direction of the driving roller $16_1$ is different from that at a second position. The driving roller $16_1$ is rotated by a driving force transmitted through its shaft and the rotating peripheral velocity differs at the first and second position of which radial sizes differ each other. The conveying velocity of the conveyor belt $12_1$ which is wound around and first position is also different from that of the second position. A difference in these conveying velocities causes the color shift of the transferred images.

Therefore, a roller which has the accurate outer diameter and a large coefficient of static friction with the conveyor belt $12_1$ is desirable as a driving roller. Generally, a rubber roller is inferior to a metallic roller when viewed from accuracy of the outer diameter. On the other hand, when viewed from coefficient of static friction, a rubber roller is superior to a metallic roller.

A metallic roller is used for the driving roller $16_1$ and the driven roller $17_1$ uses a metallic roller on which the conveyor belt $12_1$ is mounted. A pinch roller $25_1$ composed of a rubber roller is pressed against the driving roller $16_1$ at the fixed position from the outside of the conveyor belt $12_1$ so that the conveyor belt $12_1$ is wound around the driving roller $16_1$ at a winding angle above 180°.

Figure 2:
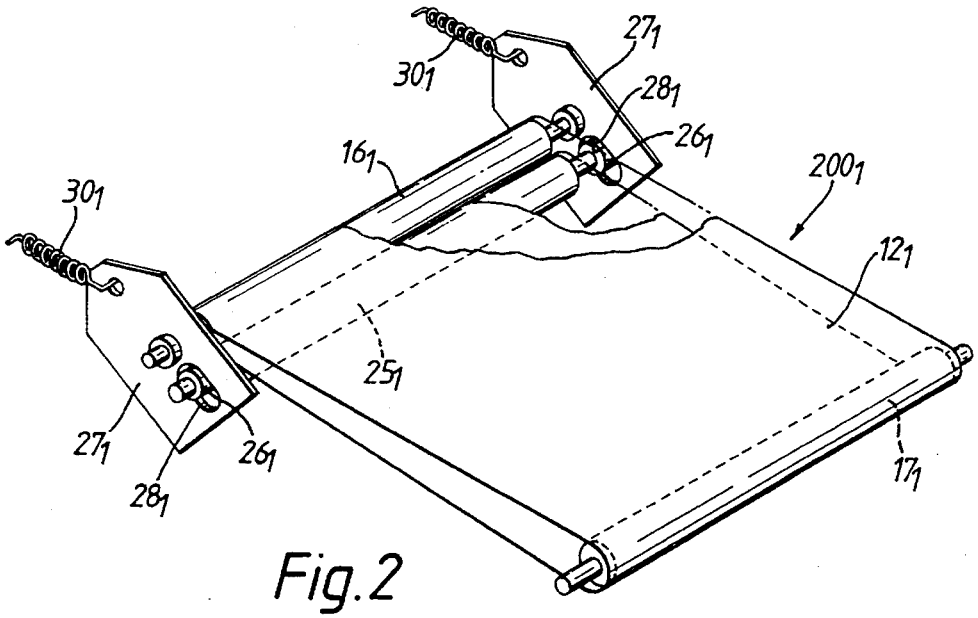
FIG. 2 is a perspective view of a conveying means using a pinch roller showing the first embodiment of the present invention.
Figure 3:
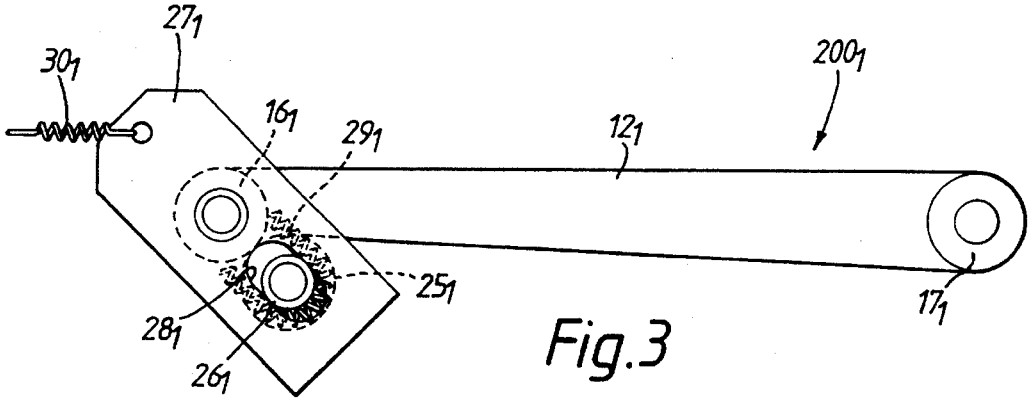
FIG. 3 is a front view of the conveying means using the pinch roller shown in FIG. 2.

FIG. 2 shows a prespective view of a system using the pinch roller $25_1$ and FIG. 3 shows its front view. Both ends of the shaft of the pinch roller $25_1$ are fixed to a bearing $26_1$ in the rotatable state. This bearing $26_1$ is put into a slot $28_1$ of the pinch roller holder $27_1$. This slot $28_1$ is provided in a state where the direction of the driving roller $16_1$ becomes long. Therefore, the pinch roller $25_1$ is movable in the direction to come in contact with/separate from the driving roller $16_1$ while rotating.

A tension spring $29_1$ is hooked on this bearing $26_1$ in the direction to apply a pressure to the rotation shaft of the driving roller. A tension spring $30_1$ is hooked on the pinch roller holder $27_1$ in the direction to have the pinch roller $25_1$ press the conveyor belt $12_1$ inward. Therefore, the pinch roller $25_1$ presses the conveyor belt $12_1$ against the driving roller $16_1$ and rolls the conveyor belt $12_1$ inward. A pressure to press the conveyor belt $12_1$ against the driving roller $16_1$ is set larger than the pressure to roll in the conveyor belt $12_1$ so that it does not move away from the driven roller $17_1$ when the pinch roller $25_1$ rolls the conveyor belt $12_1$ inward.

In this embodiment, a pressure to press the conveyor belt $12_1$ against the driving roller $16_1$ was set at 6 to 7 kg and a pressure to roll in the conveyor belt $12_1$ at 3 to 5 kg. This pressure to roll in the conveyor belt $12_1$ directly becomes a tensile force of the conveyor belt. The driving roller $16_1$ can be composed of a metallic roller using the pinch roller $25_1$ as described above and therefore, the driving roller $16_1$ of good outer diameter accuracy can be used. Further, when a metallic roller is used as the driving roller $16_1$, it is possible to drive the conveyor belt $12_1$ by the pinch roller $25_1$ without slipping against the driving roller $16_1$.

Next, the conveying means $200_2$ in the second embodiment will be described with reference to FIGS. 4 and 5.

In the second embodiment, a conveying means $200_2$ is composed in such a construction that metallic rollers are used for driving roller $16_2$ and driven roller $17_2$ over which a conveyor belt $12_2$ is put and the position of the driving roller $16_2$ only is fixed. A pinch roller $25_2$ composed of a rubber roller is pressed against the driving roller $16_2$ from the outside of the conveyor belt $12_2$.

The driven roller $17_2$ is provided with a mechanism at the shaft of both sides of the roller to make the roller movable in the direction parallel to the conveying direction of the image receiving medium 8. That is, the driven roller $17_2$ is pressed by a compression spring $18_2$ in the direction reverse to the conveying direction of the image receiving medium 8 to apply a tensile load to the conveyor belt $12_2$.

The mechanism to make the driven roller $17_2$ movable in the direction parallel to the conveying direction of the image receiving medium 8 is composed of a slot provided on the frame and a driven roller holder $21_2$ which is able to slide in the slot and holds the driven roller $17_2$ in a rotatable state.

Figure 4:
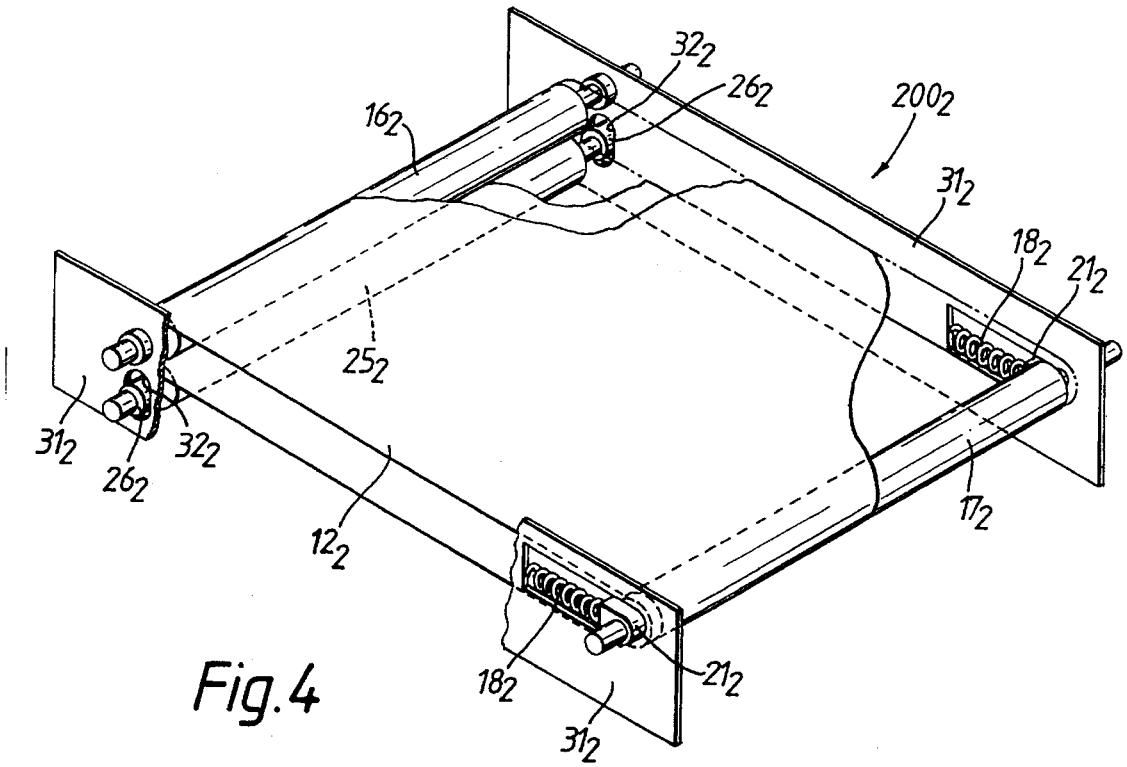
FIG. 4 is a perspective view of the conveying means using the pinch roller showing the second embodiment of the present invention.
Figure 5:
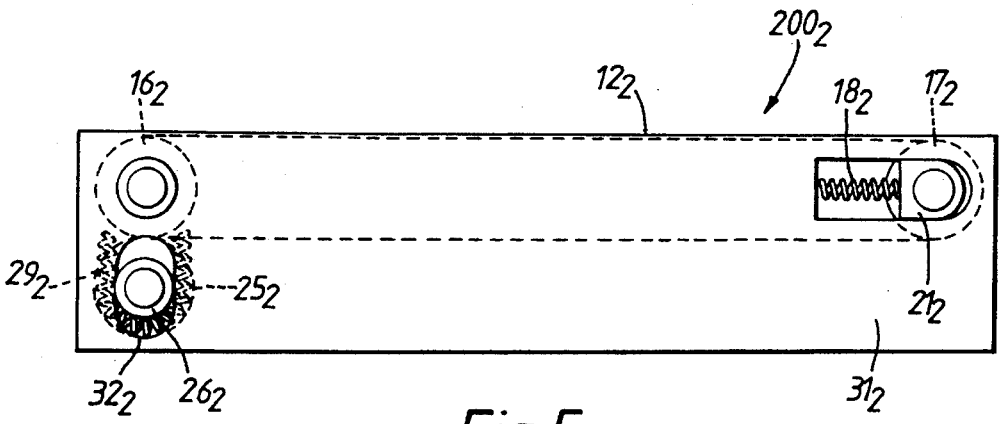
FIG. 5 is a front view of the conveying means using the pinch roller shown in FIG. 4.

FIG. 4 shows a perspective view of a system using a pinch roller and FIG. 5 shows its front view. Both ends of the shaft of the pinch roller $25_2$ are fixed to a bearing $26_2$ in the rotatable state. This bearing $26_2$ is fitted into a slot $32_2$ of a belt frame $31_2$. This slot $32_2$ is provided in a state where the direction of the driving roller $16_2$ becomes long. Therefore, the pinch roller $25_2$ is movable in the direction to come in contact with/separate from the driving roller $16_2$ while rotating.

A tension spring $29_2$ (see FIG. 5) is hooked on this bearing $26_2$ in the direction to apply a pressure to the driving roller $16_2$. Therefore, the pinch roller $25_2$ presses the conveyor belt $12_2$ against the driving roller $16_2$.

In the second embodiment, a pressure to press the conveyor belt $12_2$ against the driving roller $16_2$ was set at 6 to 7 kg and a force to apply tensile load to the conveyor belt $12_2$ by the compression spring $18_2$ was set at 3 to 5 kg. As a metallic roller can be used for the driving roller $16_2$, a driving roller in good outer diameter accuracy can be used. Further, even when a metallic roller is used for the driving roller $16_2$, it is possible to move the conveyor belt $12_2$ by the pinch roller $25_2$ without slipping against the driving roller $16_2$.

As described above, use of the pinch roller $25_2$ in a simple construction makes it possible to prevent the conveyor belt $12_2$ from slipping against the driving roller $16_2$ and eliminate an image color shift on the image receiving medium in the conveying direction due to the slip of the conveyor belt.

Next, a conveying means $200_3$ in the third embodiment will be described with reference to FIGS. 6 and 7.

In the third embodiment, a metallic roller is used for a driving roller $16_3$ and a driven roller $17_3$ on which a conveyor belt $12_3$ is put. These rollers $16_3$ and $17_3$ are fixed and a winding roller $33_3$, which is a rubber roller, is arranged while pressing it from the outside of the conveyor belt $12_3$. The winding angle of the conveyor belt to the driving roller is set at below 180°.

Figure 6:
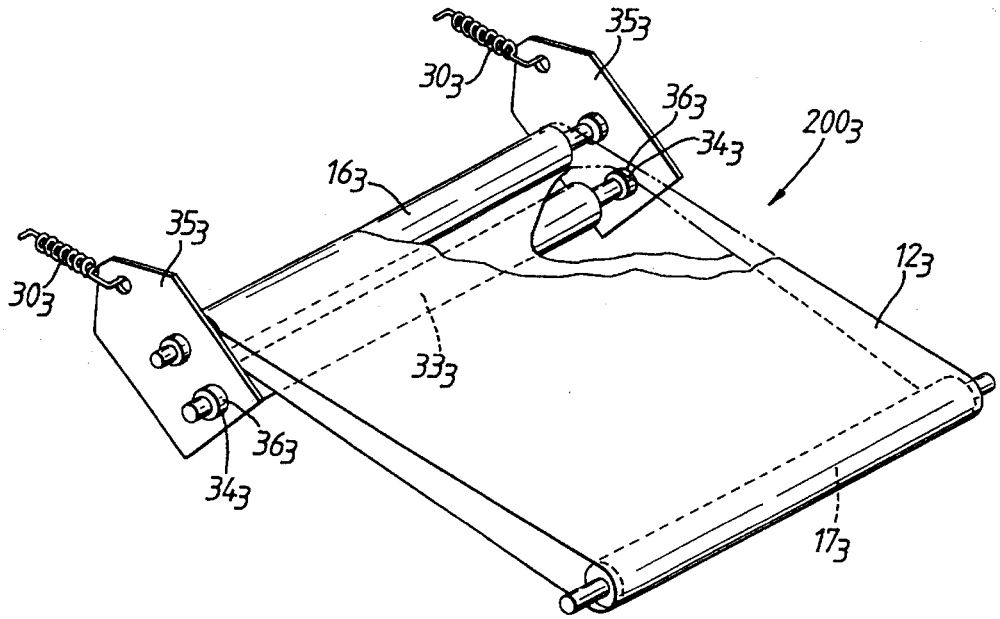
FIG. 6 is a perspective view of the conveying means using a winding roller showing the third embodiment of the present invention.
Figure 7:
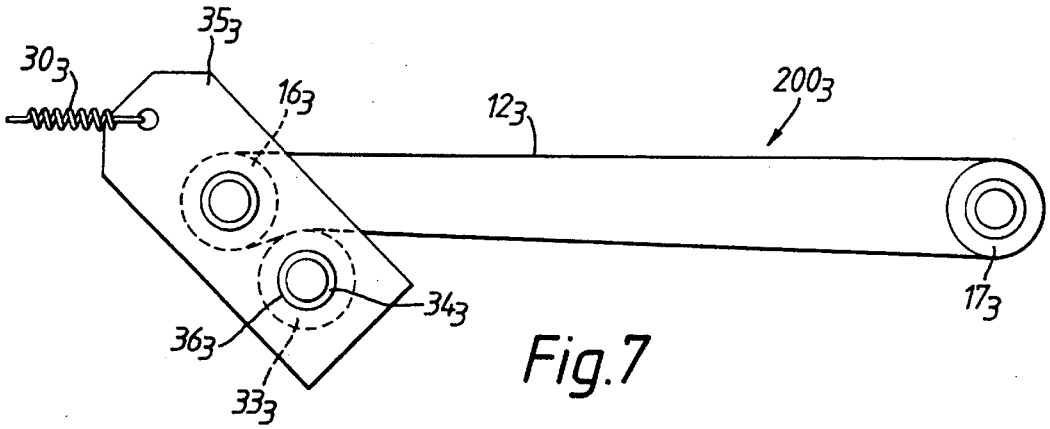
FIG. 7 is a front view of the conveying means using the winding roller shown in FIG. 6.

FIGS. 6 shows a perspective view of a system using the winding roller $33_3$ and FIG. 7 shows its front view. Reference number $34_3$ shows a pair of winding roller bearings, $35_3$ shows a pair of winding roller holders and $36_3$ shows holes provided on the winding roller holders $35_3$. The rotary shafts at both sides of the winding roller $33_3$ are fixed to the bearings $34_3$ in a rotatable state. The bearings $34_3$ are fitted in the holes $36_3$ of the winding roller holders $35_3$, respectively.

These holes $36_3$ are provided at positions parallel to the shaft of the driving roller $16_3$. Each of the winding roller holders $35_3$ is provided with a tensile spring $30_3$ which gives a tensile force to the conveyor belt $12_3$ by pressing the winding roller $33_3$ against the inside of the conveyor belt $12_3$. Therefore, the winding roller $33_3$ is able to bring the conveyor belt $12_3$ in contact with the driving roller $16_3$ at a winding angle above 180°. A tensile force to be generated on the conveyor belt $12_3$ when the winding roller $33_3$ rolls the conveyor belt $12_3$ in was so set that it becomes 3 to 5 kg.

Next, a conveying means $200_4$ in the fourth embodiment will be described with reference to FIGS. 8 and 9.

In the fourth embodiment, a metallic roller is used for a driving roller $16_4$ and a driven roller $17_4$ over which a conveyor belt $12_4$ is put, and only the position of the driving roller $16_4$ is fixed. A winding roller $33_4$ which is a rubber roller, is fixed to press the conveyor belt $12_4$ from its outside at the center of the driving roller $16_4$ and the driven roller $17_4$.

The driven roller $17_4$ is provided with a mechanism which makes it movable in the direction parallel to the conveying direction of the image receiving medium 8 at the shaft at both sides of the roller. That is, the driven roller $17_4$ is pressed by a compression spring $18_4$ in the direction reverse to the conveying direction of the image receiving medium 8 to apply a tensile load to the conveyor belt $12_4$.

The mechanism to make the driven roller $17_4$ movable in the direction parallel to the conveying direction of the image receiving medium 8 is composed of slot $32_4$ provided on the frame $31_4$ and a driven roller holder $21_4$ which is able to slide in the slot $32_4$ and holds the driven roller $17_4$ in the rotatable state.

Figure 8:
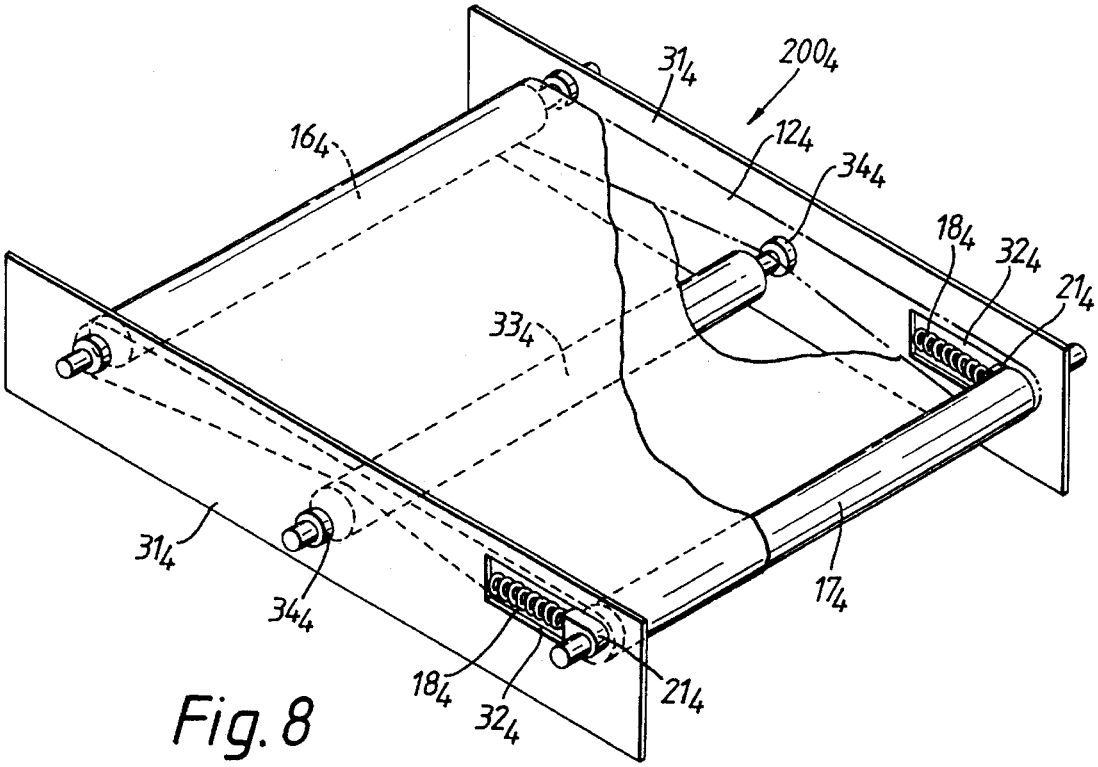
FIG. 8 is a perspective view of the conveying means using a winding roller showing the fourth embodiment of the present invention.
Figure 9:
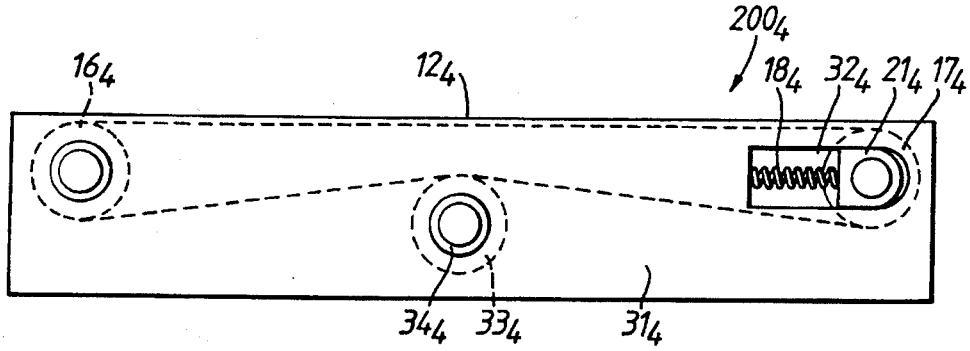
FIG. 9 is a front view of the conveying means using the winding roller shown in FIG. 8.

FIG. 8 shows a perspective view of a system using a winding roller $33_4$ and FIG. 9 shows its front view. Reference number $34_4$ shows a bearing of the winding roller $33_4$ and $31_4$ shows a belt frame. Both ends of the shaft of the winding roller $33_4$ are fixed to bearings $34_4$ in a rotatable state. The bearing $34_4$ is fitted in a hole provided on the belt frame $31_4$. This hole is provided at a position where the winding roller $33_4$ presses the conveyor belt $12_4$ against the inside and it is parallel to the driving roller $16_4$. Therefore, the winding roller $33_4$ is able to bring the conveyor belt $12_4$ in contact with the driving roller $16_4$ at a winding angle above 180°.

In this fourth embodiment, the compression spring $18_4$ is compressed as the conveyor belt $12_4$ is pressed inward by the winding roller $33_4$ to give a tensile load of 3 to 5 kg to the conveyor belt $12_4$.

As a metallic roller can be used for the driving roller $16_4$ when the winding roller $33_4$ is used as described above, it becomes possible to use the driving roller $16_4$ in good outer diameter accuracy. Further, even when a metallic roller is used for the driving roller $16_4$, a large contact area between the driving roller $16_4$ and the conveyor belt $12_4$ can be made available by the winding roller $33_4$ and therefore, it is possible to drive the conveyor belt $12_4$ without slipping against the driving roller $16_4$.

As described in detail in the above, use of the winding roller $33_4$ in very simple construction makes it possible to move the conveyor belt $12_4$ at a constant velocity without slipping between the conveyor belt $12_4$ and the driving roller $16_4$. Accordingly, it is also possible to eliminate the color shift on the formed images transferred on the image receiving medium 8 in the conveying direction of the conveyor belt $12_4$.

Next, a conveying means $200_5$ in the fifth embodiment will be described with reference to FIGS. 10 and 11.

Figure 10:
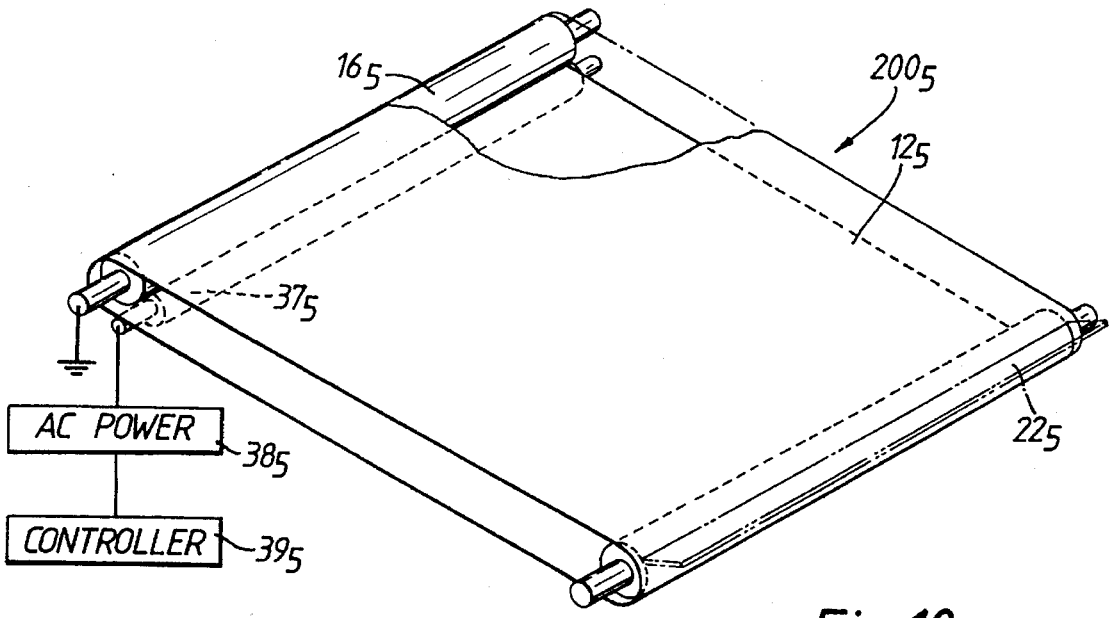
FIG. 10 is a perspective view of the conveying means with a discharging roller provided showing the fifth embodiment of the present invention.
Figure 11:
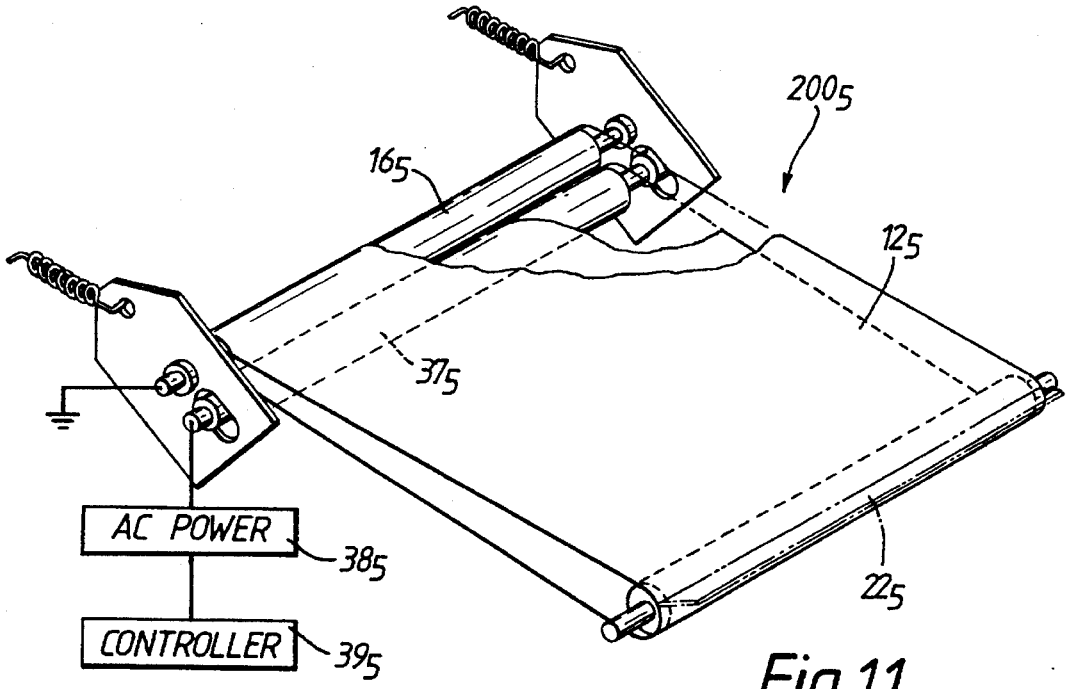
FIG. 11 is a prespective view of the conveying means with the discharging roller shown in FIG. 10 provided as the pinch roller shown in the first embodiment.

FIG. 10 shows a perspective view of a system using a discharging roller $37_5$. Reference number $38_5$ is an AC power supply unit and $39_5$ is a controller. A driving roller $16_5$ is composed of a metallic roller with a conductive rubber wound around it and therefore it is conductive. The driving roller $16_5$ is electrically earthed. A conveyor belt $12_5$ is wound around the driving roller $16_5$ and a conductive metallic discharging roller $37_5$ is provided in contact with the conveyor belt $12_5$.

The discharging roller $37_5$ is arranged in contact with the conveyor belt $12_5$. In this embodiment, the metallic discharging roller $37_5$ is used but is not limited to a roller if it is conductive. For instance, a conductive brush, a conductive brush roller or a conductive plastic roller can be used. The discharging roller $37_5$, is connected to an AC power supply unit $38_5$ which is an AC voltage supply means for supplying AC voltage.

The AC power supply unit $38_5$ is connected to the controller $39_5$ which is a control means for controlling the AC power supply unit $38_5$. The conveyor belt $12_5$ passes through this discharging roller $37_5$ with the rotation of the driving roller $16_5$. The controller $39_5$ controls the AC power supply unit $38_5$ to supply AC voltage to the discharging $37_5$ according to a preset program. As a result, the surface of the conveyor belt $12_5$ charged to plus and the back side charged to minus are neutralized. Thereafter, the conveyor belt $12_5$ is moved to a belt cleaning device $22_5$ in the neutralized state. Thus, when the conveyor belt $12_5$ is discharged and moved to the belt cleaning device $22_5$, the belt can be easily cleaned. Further, as a result of this discharging, the image transfer can be made under the same charged condition of the conveyor belt $12_5$ and it is unnecessary to change transfer voltage in a continuous image transfer.

As an example of application, it is possible to use the pinch roller $25_1$ described in the first embodiment as the discharging roller $37_5$. In this case, as the characteristic of the pinch $25_1$, a material having a high coefficient of friction is needed and when a conductive rubber roller is used for the pinch roller $25_1$, it becomes possible to construct a pinch roller which also serves as a discharging roller.

Further, in this case it is also necessary to make the pinch roller bearing or the pinch roller holder using an electrically insulated material in order to prevent the discharging voltage from flowing to the driving roller through the bearing.

As described in detail in the above, according to this fifth embodiment, it is possible to discharge the surface of the conveyor belt by a very simple mechanism without generating ozone.

Next, a conveying means $200_6$ in the sixth embodiment will be described with reference to FIGS. 12 to 16.

Figure 12:
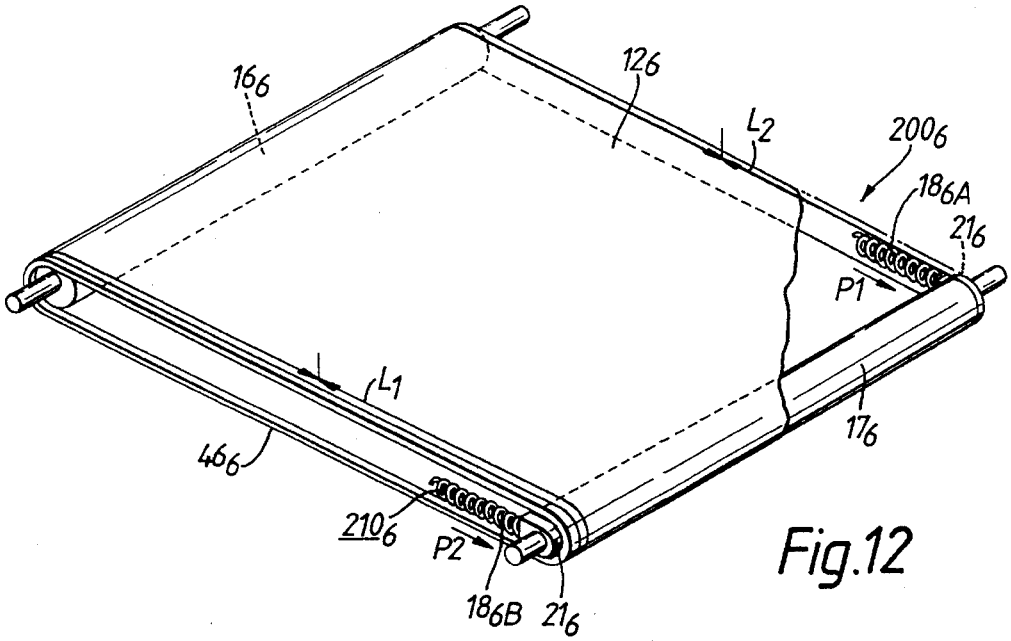
FIG. 12 is a perspective view showing the sixth embodiment of the present invention less a part of the conveying means which is its essential part.

FIG. 12 shows the outline of the construction of a conveying means $200_6$. Reference number $12_6$ shows a conveyor belt, $16_6$ shows a driving roller, $17_6$ shows a driven roller, $46_6$ shows a regulation belt, $18_6$A and $18_6$B show a first compression spring and a second compression spring to give a tensile force to the conveyor belt $12_6$, and $21_6$ shows a driven roller bearing. The regulation belt $46_6$ is mounted or formed along an inner side at one end of the conveyor belt $12_6$. The endless type conveyor belt $12_6$ is driven by the driving roller $16_6$ and the driven roller $17_6$. The driven roller $17_6$ gives a tensile force to the conveyor belt $12_6$ when its bearing $21_6$ is pressed by the first and the second compression springs $18_6$A and $18_6$B.

When a cause for generating a skid of the conveyor belt $12_6$ was investigated to reveal that it was largely affected by a difference in pressures generated by the first and the second compression springs $18_6$A and $18_6$B. The results of this test are shown in FIGS. 13 and 14.

Figure 13:
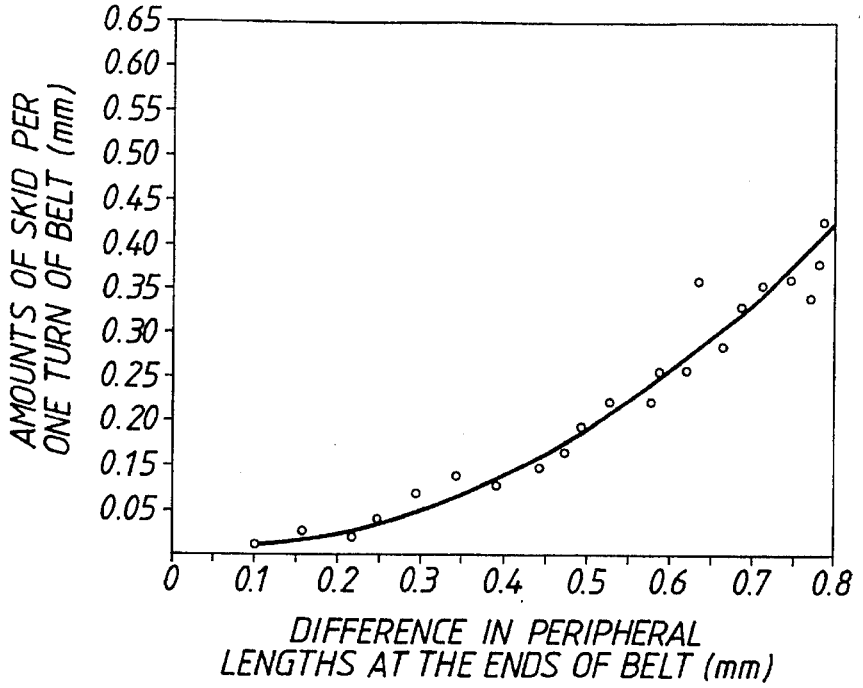
FIG. 13 is a graph showing a test result of difference in peripheral lengths and amount of skid movement of the conveyor belt.

FIG. 13 shows the test result of amounts of skid per one turn of an endless type conveyor belt which was prepared by cutting a belt into several pieces in trapezoidal shape intentionally giving different peripheral lengths and connecting their ends to an endless conveyor belt. The axis of abscissa shows differences in peripheral lengths at the ends of a belt and the axis of ordinate shows amount of skid per one turn of the belt.

In this test, for the purpose of making clear an effect of only peripheral length of the belt, a precisely prepared weight is used for giving a tensile force to the belt. Further, the shorter peripheral length side was made as the plus side of skid direction of the belt. As a result, it is seen that the more larger a difference in peripheral lengths becomes, the more larger the skid becomes. Furthermore, it is also seen that the skid progresses at the shorter peripheral length side of the belt.

Figure 14:
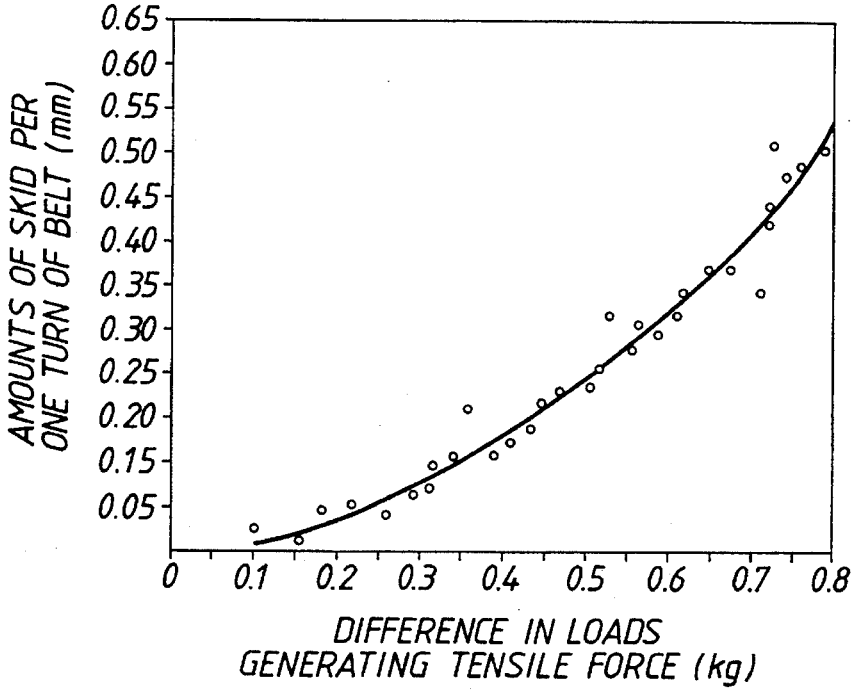
FIG. 14 is a graph showing a test result of weighing and skid amount of the conveyor belt.

On the other hand, shown in FIG. 14 is amount of skid per one turn of the belt measured by changing a difference in loads applied at both sides, and a difference in spring loads generating a tensile force is shown. The axis of abscissa shows differences in spring loads generating tensile force and the axis of ordinate shows amount of skid per one turn of the belt on the axis of ordinates.

The graph in FIG. 14 shows "Difference in Spring Loads Generating Tensile Force". In this test, for the purpose of conducting the test by making the load difference clear, a precisely prepared weight was used.

Further, for the purpose of investigating an effect of load difference only, a belt manufactured precisely in micron unit on an experimental basis was used. Further, the side of the belt having a larger tensile force generating spring load applied was made as the plus side of skid direction of the belt.

As a result, it is seen that the larger a load difference becomes, the larger the degree of skid becomes correspondingly. Further, it is also seen that the skid of the belt progresses at the side with a larger belt tensile force generating spring load.

Now, these two test results can be summarized as follows:

(1) The skid of the belt progresses at the short peripheral length side.

(2) The skid of the belt progresses at the large load side.

On the other hand, it is impossible to make the peripheral lengths of the conveyor belts $12_6$ completely equal on all actual apparatus. Further, it is also impossible to completely eliminate fluctuations of the first and the second compression springs $18_6$A and $18_6$B.

It was decided to control the direction of skid of the conveyor belt $12_6$ based on the above results in this embodiment.

That is, as illustrated in FIG. 12, the endless type conveyor belt $12_6$ put over the driving roller $16_6$ and the driven roller $17_6$ is made in the construction having a difference in its peripheral lengths at both sides of L1>L2 when the peripheral lengths at both sides are L1 and L2.

As a means for giving a tensile force to the conveyor belt $12_6$, a tensioning mechanism $210_6$ is composed of a first and a second compression springs $18_6$A and $18_6$B which are a first and a second tensioning members. That is, the first compression spring $18_6$A having a strong pressure P1 is arranged at the shorter peripheral length L2 side of the conveyor belt $12_6$ and the second compression spring $18_6$B having a weak pressure P2 (P1>P2) is arranged at the longer peripheral length L1 side.

As a result of this construction, the conveyor belt $12_6$ skids always to the first compression spring $18_6$A side having a strong pressure P1 at the shorter peripheral length L2 side.

On the other hand, a regulation belt $46_6$ is provided along the peripheral edge of the conveyor belt $12_6$ with the second compression spring $18_6$B having a weak pressure P2 arranged at the longer peripheral length L1 side. And, by bringing this regulation belt $46_6$ in contact with the end of the driven roller $17_6$ (or the driving roller $16_6$), the skid of the conveyor belt $12_6$ is prevented.

Figures 15A, 15B, 15C:
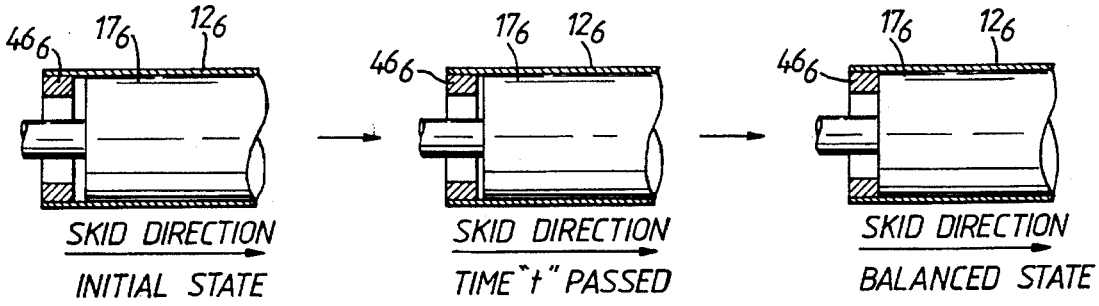
FIG. 15A through 15C are cross-sectional views showing the positional relation between the conveyor belt and the regulation belt.

The construction of this regulation belt $46_6$ is as shown in FIGS. 15A to 15C. That is, this regulation belt $46_6$ is in the thick belt shape and provided along the back side of the peripheral edge of the conveyor belt $12_6$ with the second compression spring $18_6$B arranged.

As the conveyor belt $12_6$ always skids to the first compression spring $18_6$A side having the strong pressure P1 at the shorter peripheral length L2 side, after a time "t" passed shown in FIG. 15B from the initial state shown in FIG. 15A, the regulation belt $46_6$ runs against the end of the driven roller $17_6$ to prevent the further movement of the conveyor belt, which is then brought in the balanced state.

Figure 16:
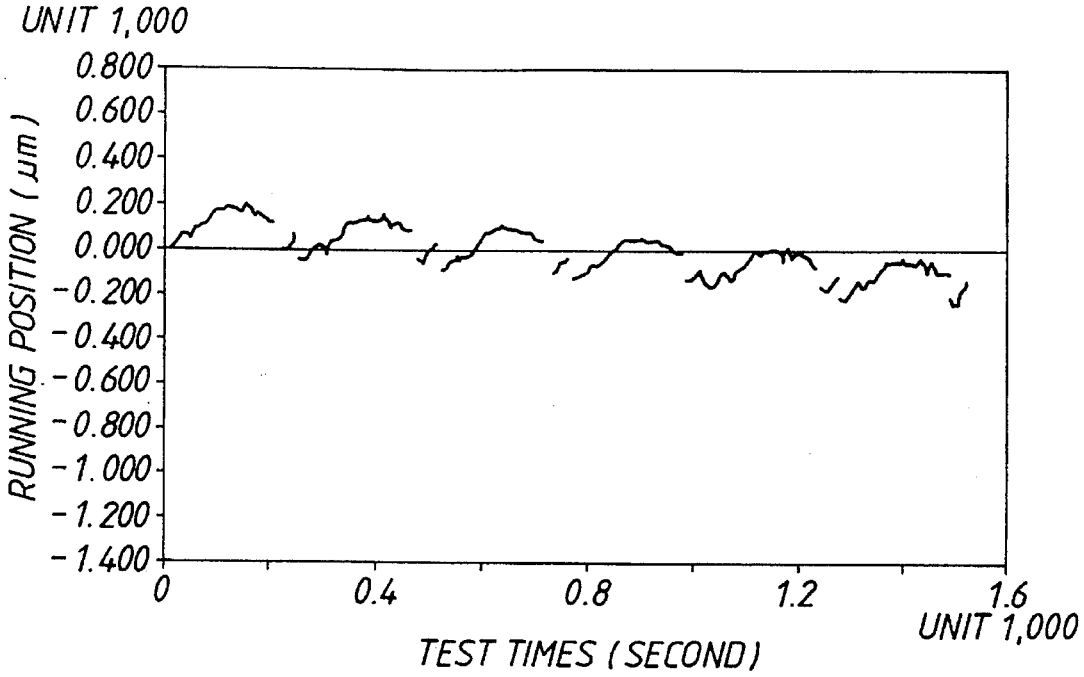
FIG. 16 is a graph showing the state of skid movement of the conveyor belt when the construction of the sixth embodiment is not adopted.

FIG. 16 shows the result of the skid of the conveyor belt when the measures described above were not taken and FIG. 17 shows the result of the skid of the conveyor belt when the measures described above were taken.

As the results of this test, running times of the belt shown in "Test Time (Second)" are plotted on the axis of abscissas and "Running Position (μm)" showing amounts of the skids of the belt are plotted on the axis of ordinates.

As clear from these test results, the amount of the skid of the belt which was traveled without setting its mounting and pressure was large, the color shift of images on the image receiving medium 8 tends to occur in the direction perpendicular to the moving direction of the conveyor belt $12_6$. However, the skid of the conveyor belt is very small when the belt was traveled with its mounting and pressure set, and it can be seen that the conveyor belt $12_6$ was in the stable running state scarcely causing the color shift of images on the image receiving medium 8 in the direction perpendicular to the moving direction of the conveyor belt $12_6$.

Figure 17:
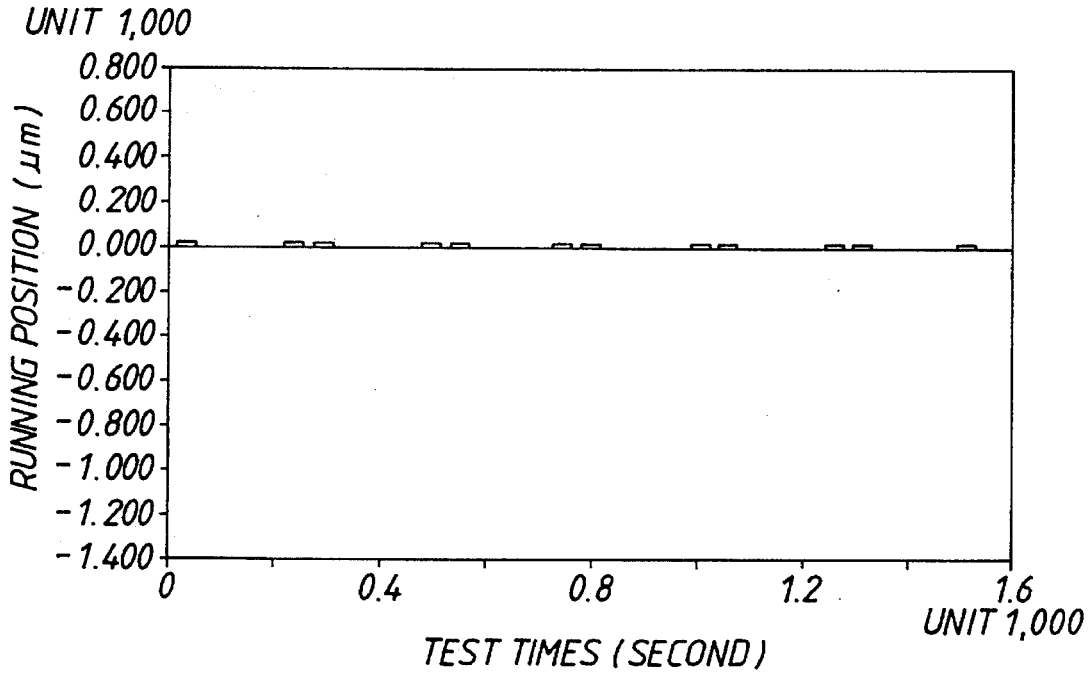
FIG. 17 is a graph showing the state of skid movement of the conveyor belt when the construction of the sixth embodiment is adopted.

The test results shown in FIGS. 16 and 17 are one example. A further statistic test revealed that the same effect is obtained up to a difference in peripheral lengths of 2 mm of both sides of a belt if a difference in pressures applied is suppressed to accuracy of 1 kg according to the construction in the sixth embodiment. Accuracy of length ±0.01 mm and pressure ±50 g was demanded for a conventional belt and therefore, when a belt in this construction is used, it is possible to effectively control and restrain the skid direction without demanding high accuracy.

As described above, the conveying means in the sixth embodiment is capable of controlling the skid of the conveyor belt $12_6$ in a very simple construction.

Next, a conveying means $200_7$ in the seventh embodiment will be described with reference to FIGS. 18 to 23.

Figure 18:
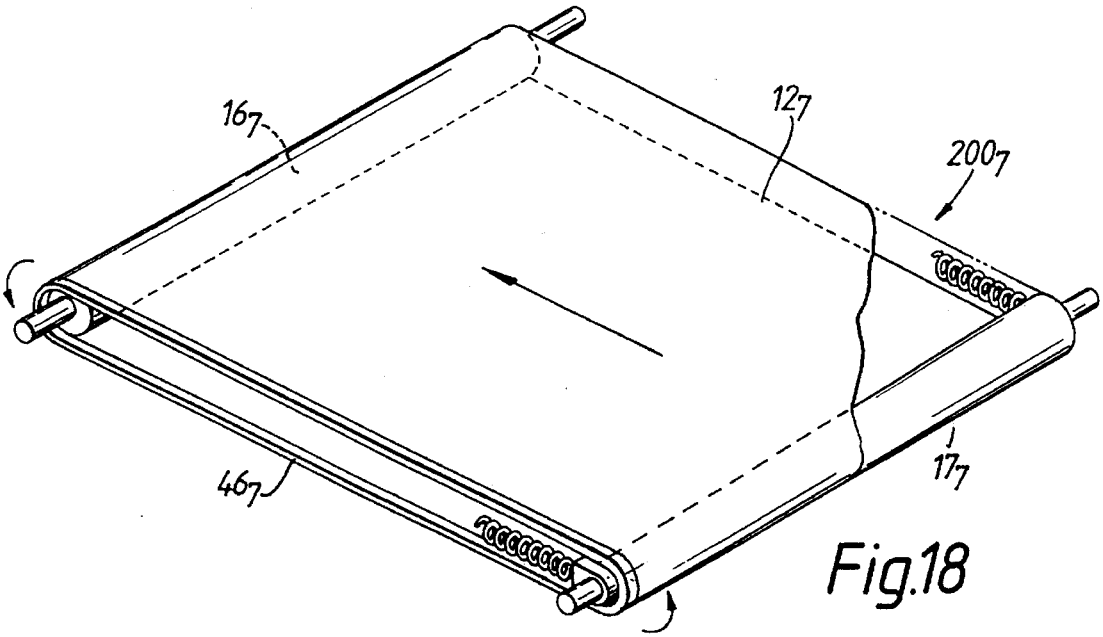
FIG. 18 is a perspective view showing the seventh embodiment of the present invention less a part of the conveying means which is its essential part.
Figure 19:
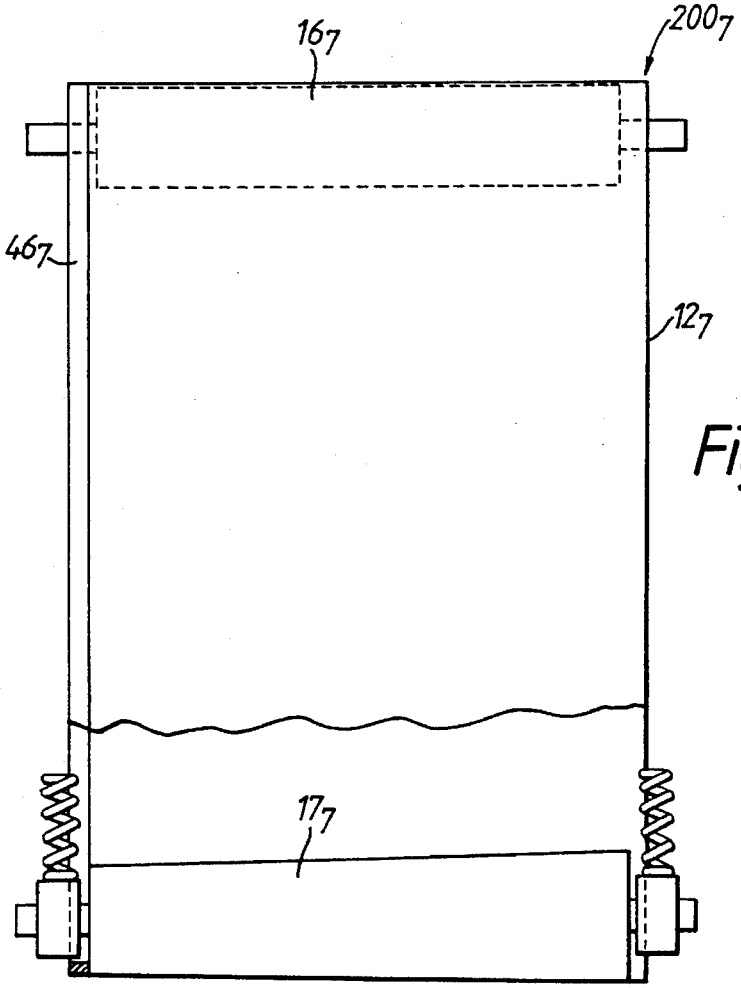
FIG. 19 is a plan view of the seventh embodiment less a part of the conveying means.

As illustrated in FIGS. 18 and 19, a tapered roller $17_7$ is used as a driven roller. This roller is tapered so that its diameter is increased gradually to a large diameter from one end to another end. The regulation belt $46_7$ is positioned at the small diameter side of the tapered roller $17_7$ and mounted along the back side of the peripheral edge of a conveyor belt $12_7$ in the same manner as in FIGS. 15A to 15C.

When the conveyor belt $12_7$ is put over driving roller $16_7$ and the tapered roller $17_7$ which is a driven roller, the conveyor belt $12_7$ skids toward the large diameter of the tapered roller $17_7$.

Figure 20:
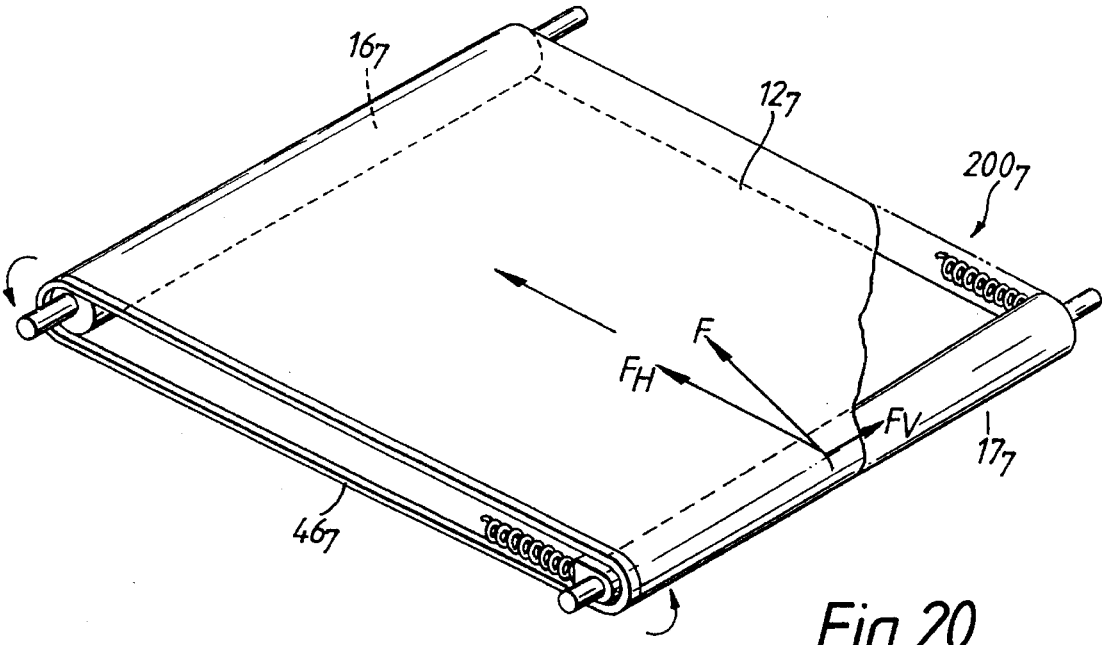
FIG. 20 is a perspective view for explaining the skid movement of the conveyor belt in the seventh embodiment.

In this case, on the conveyor belt $12_7$ being pulled along the tapered roller $17_7$, a tensile force F acting in the vertical direction is first generated on its inclined portion, which is above the inclined portion of the tapered roller $17_7$ as illustrated in FIG. 20. When the conveyor belt $12_7$ is moving, the tensile force F is divided into FH in the belt conveying direction and $F_V$ in the vertical direction and these divided forces act on the conveyor belt. The direction $F_V$ vertical to the conveying direction of the belt is the direction toward the large diameter of the tapered roller $17_7$ and the conveyor belt $12_7$ is moved one-sidedly toward the direction of the large diameter of the tapered roller $17_7$ by this force $F_V$. That is, the direction of the skid of the conveyor belt $12_7$ can be controlled using the tapered roller $17_7$ as a driven roller.

If the direction of the skid can be controlled, a single piece of the belt $46_7$ is sufficient to restrain progress of the skid. That is, it can be achieved by providing the regulation belt $46_7$ only at the inside of the conveyor belt $12_7$ at its small diameter side.

That is, the conveyor belt $12_7$ skids toward the large diameter side but when the conveyor belt $12_7$ moves one-sidedly for a certain amount, the skid regulation belt $46_7$ is slid to the roller end surface of the small diameter side of the tapered roller $17_7$, stopping the further skid at a position where the skid force of the conveyor belt $12_7$ is balanced with the rubber repulsive force of the guide $46_7$.

Once these forces are balanced each other, the conveyor belt $12_7$ is moved continuously in this balanced stated.

Figure 21:
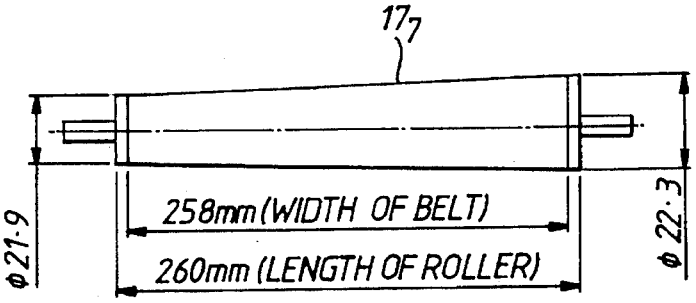
FIG. 21 is a front view for explaining the size and tapered state of a tapered roller used in the seventh embodiment.

FIG. 21 shows a definite dimensional relation of the shape of the tapered roller $17_7$ and the conveyor belt $12_7$ which were used in the seventh embodiment. That is, the tapered roller $17_7$ is 260 mm long and the conveyor belt $12_7$ put on this tapered roller $17_7$ is 258 mm wide. The diameter of the large diameter portion of this tapered roller $17_7$ is 22.3 mm and that of the small diameter portion is 21.9 mm. Therefore, as shown by the following expression, this tapered roller $17_7$ has a taper of 0.001538.

$$22.3-21.9/260=0.001538$$

Figure 22:
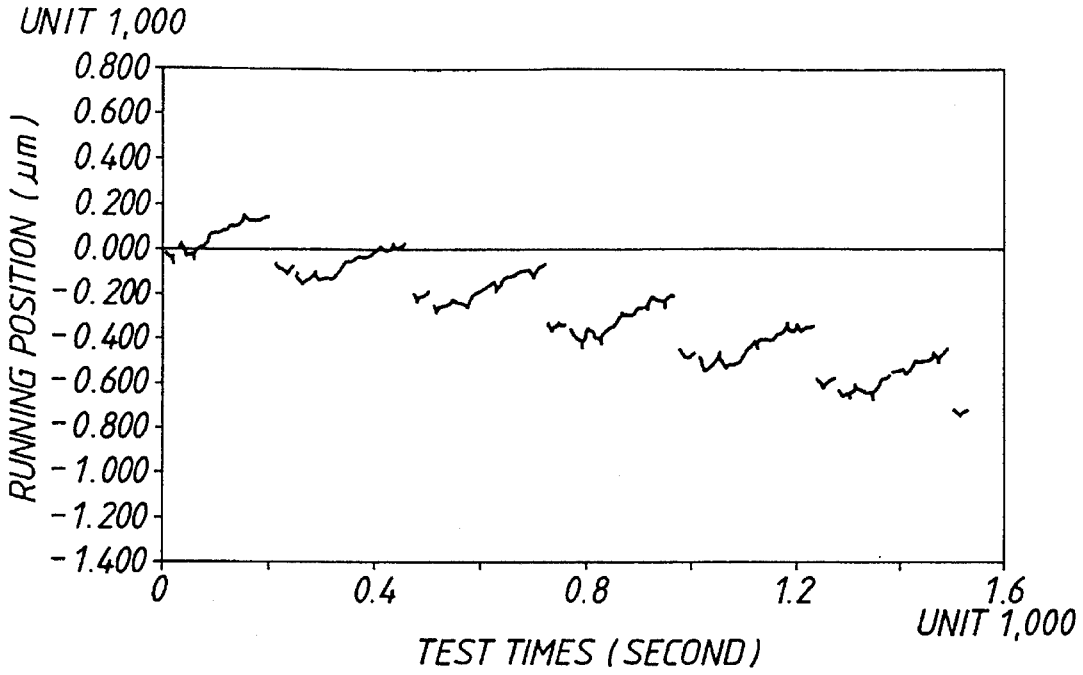
FIG. 22 is a graph showing the state of skid movement of the conveyor belt when the construction of the seventh embodiment is not adopted.
Figure 23:
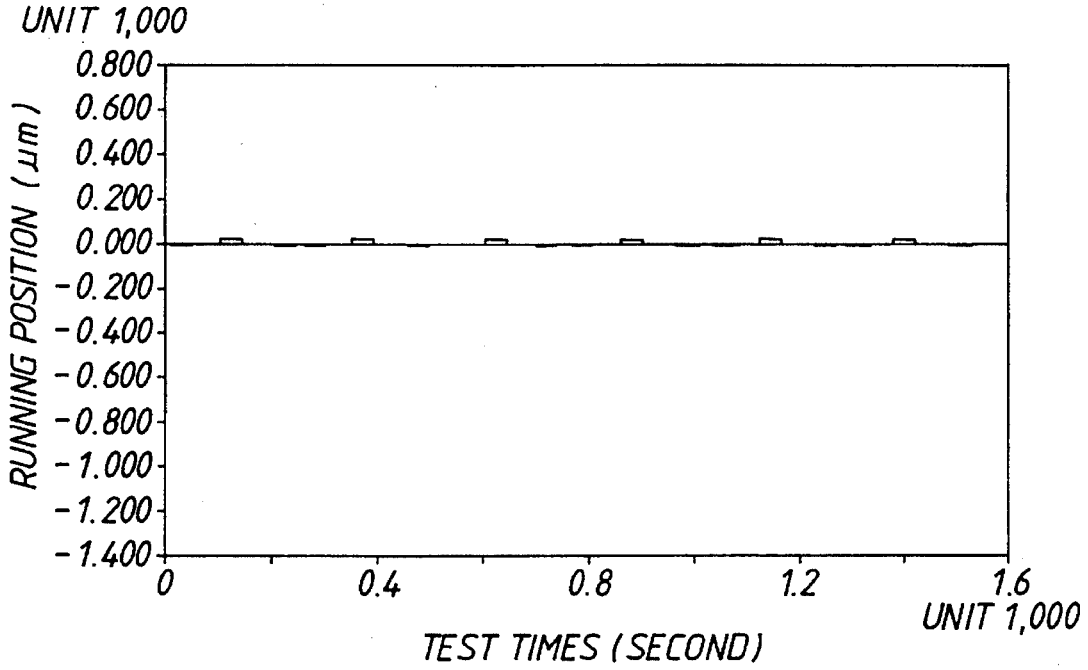
FIG. 23 is a graph showing the state of skid movement of the conveyor belt when the construction of the seventh embodiment is adopted.

FIG. 22 shows the test result of skid of the conveyor belt when no measures described above were taken and FIG. 23 shows the test result of skid of the conveyor belt when the measures described above were taken.

As the result of this test, "Test Times (Sec.)" showing the running times of the conveyor belt were plotted on the axis of abscissas and "Running Positions (μm)" showing amount of skid of the conveyor belt were plotted on the axis of ordinates.

Therefore, the skid of the conveyor belt when it was moved without taking any measure is large while the color shift of images on the image receiving medium 8 tends to occur in the direction perpendicular to the moving direction of the conveyor belt $12_7$. However, it is seen that the skid of the conveyor belt when it was moved with the tapered roller $17_7$ and the regulation belt $46_7$ provided is very small and the belt ran in the stable state scarcely causing the color shift of images on the image receiving medium 8 in the direction perpendicular to the moving direction of the conveyor belt $12_7$.

The tapered roller $17_7$ shown in this seventh embodiment is not needed to be applied as a driven roller, and when used as a third roller other than the driving roller $16_7$ and the driven roller $17_7$, its effect will not be changed. Further, it is also not required to have the tapered roller $17_7$ act from the inside of the conveyor belt $12_7$ and its effect is not changed even when it was acted on the surface of the conveyor belt $12_7$.

Further, in this seventh embodiment the tapered roller $17_7$ was described as a driven roller and its small diameter side end surface was explained as the surface contacting the regulation belt $46_7$. However, not limited to these usages, the end surface of the driving roller $16_7$ may be used as the skid prevention surface and even when a roller having an original skid prevention surface is provided, its effect will not be changed.

As described above, the skid of the conveyor belt $12_7$ can be controlled by a mechanism in very simple construction.

Next, a conveying means $200_8$ in the eighth embodiment will be described with reference to FIGS. 24 to 28.

Figure 24:
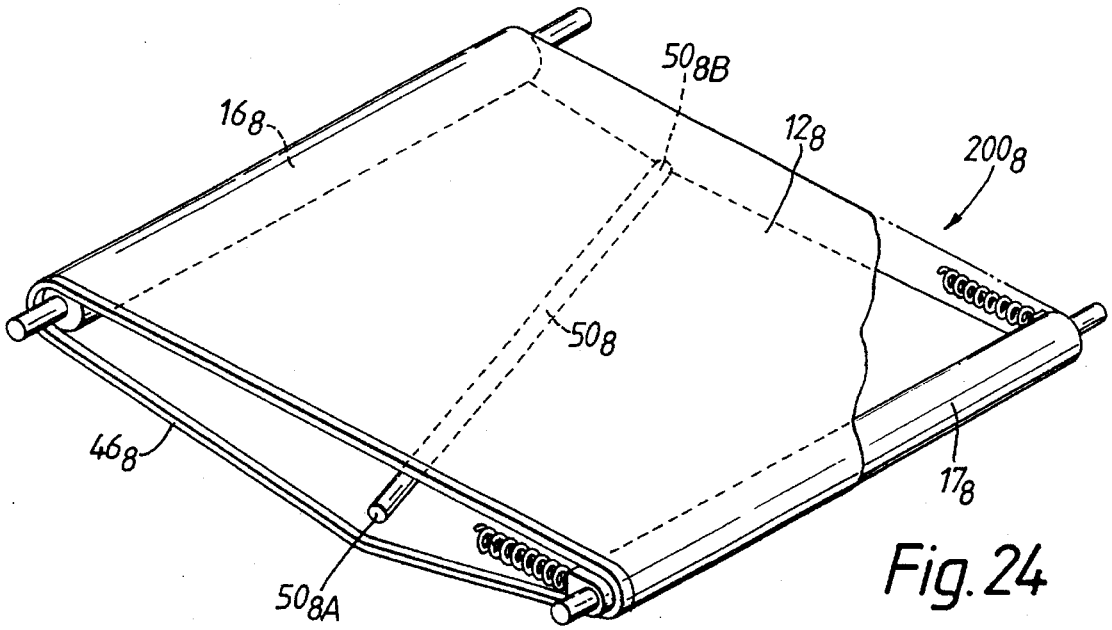
FIG. 24 is a perspective view showing the eighth embodiment less a part of the conveying means which is its essential part.
Figure 25:
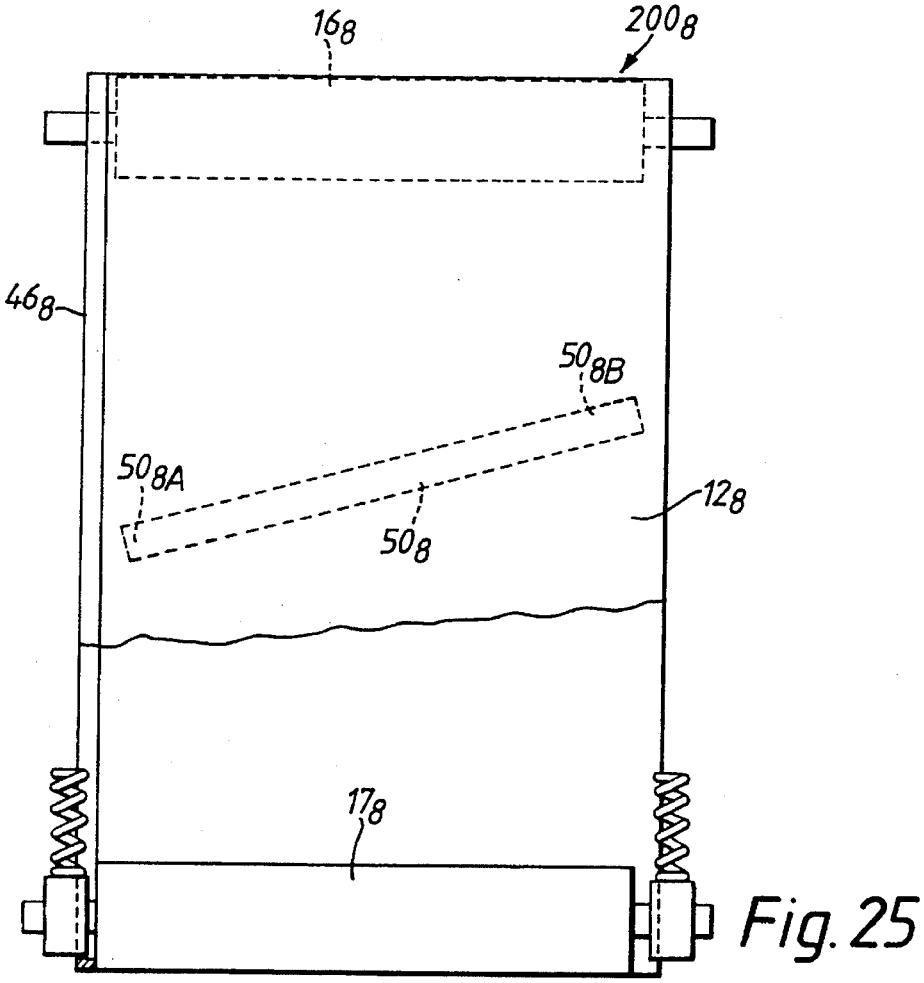
FIG. 25 is a plan view showing the eighth embodiment less a part of the conveying means.

As illustrated in FIGS. 24 and 25, between the driving roller $\mathbf{16}_8$ and the driven roller $\mathbf{17}_8$ arranged parallel to each other, there is a diagonal roller $\mathbf{50}_8$ arrange diagonally to these rollers $\mathbf{16}_8$ and $\mathbf{17}_8$. That is, it is arranged so that its one end $\mathbf{50}_8$A is close to the driven roller $\mathbf{17}_8$ and another end $\mathbf{50}_8$B is close to the driving roller $\mathbf{16}_8$.

Further, this diagonal roller $\mathbf{50}_8$ is arranged slightly below the plane surface connecting a driving roller $\mathbf{16}_8$ and a driven roller $\mathbf{17}_8$ and functions as a skid moving direction control roller. A conveyor belt $\mathbf{12}_8$ is put over these driving roller $\mathbf{16}_8$, the diagonal roller $\mathbf{50}_8$ and the driven roller $\mathbf{17}_4$. On the other hand, a regulation belt $\mathbf{46}_8$ is provided along the side edge of the conveyor belt $\mathbf{12}_8$ having a longer distance between the driving roller $\mathbf{16}_8$ and the diagonal roller $\mathbf{50}_8$. The regulation belt $\mathbf{46}_8$ is in the construction as illustrated in FIGS. 15A to 15C.

In the conveying means $\mathbf{200}_8$ in this construction, when moved, the conveyor belt $\mathbf{12}_8$ progressively skids toward the end having a shorter distance between the diagonal roller $\mathbf{50}_8$ and the driving roller $\mathbf{16}_8$, that is, the conveyor belt $\mathbf{12}_3$ skids to the end $\mathbf{50}_8$B of the diagonal roller $\mathbf{50}_8$.

Figure 26:
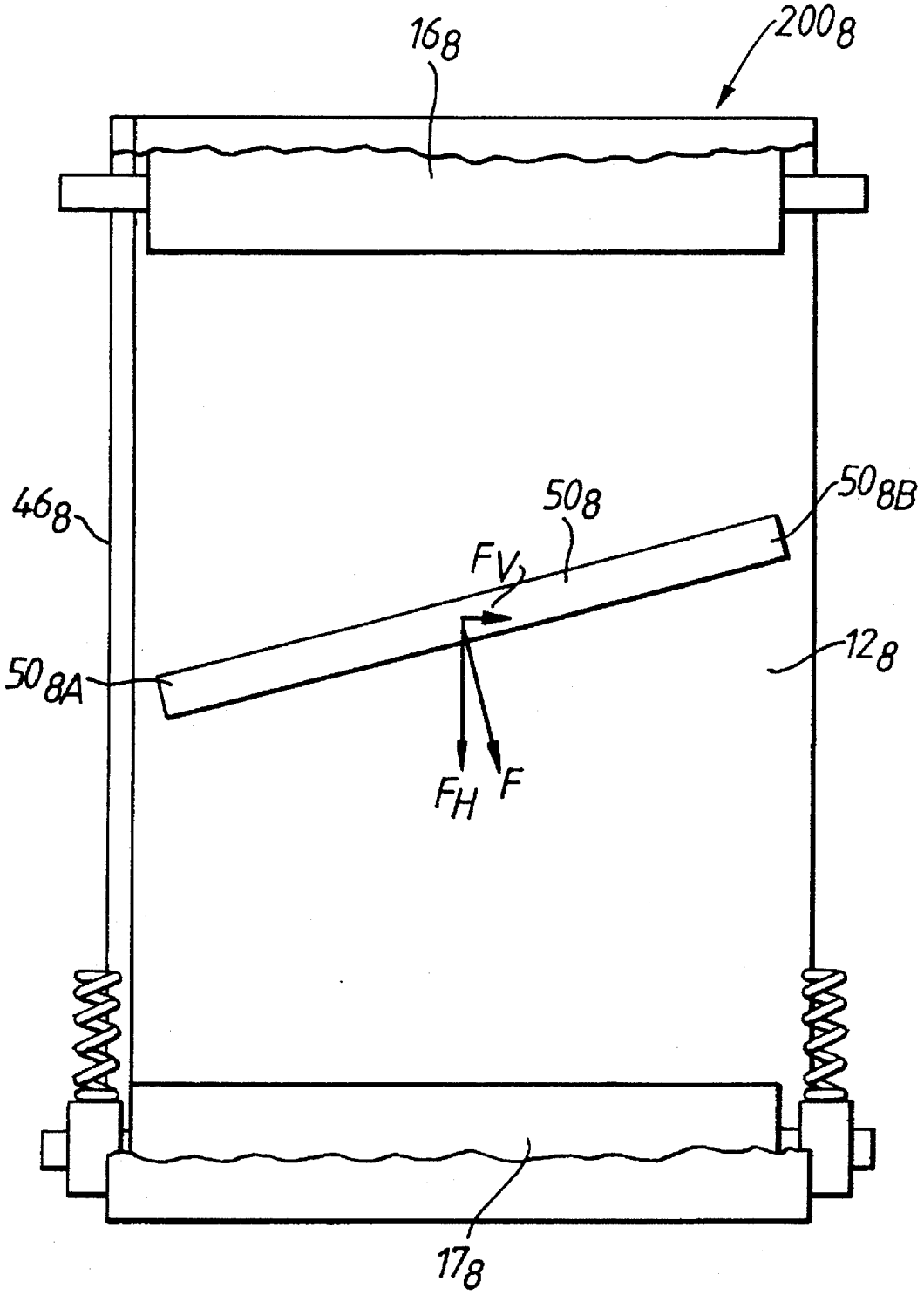
FIG. 26 is a perspective view for explaining the skid movement of the conveyor belt in the eighth embodiment.

As illustrated in FIG. 26, the conveyor belt $\mathbf{12}_8$ is first twisted by the diagonal roller $\mathbf{50}_8$ and a tensile force F is generated in the direction vertical to the central axis of rotation of the diagonal roller $\mathbf{50}_8$. In actual operation, this force F is divided into two forces which act in the belt conveying direction $F_H$ and in the direction $F_V$ vertical to the belt conveying direction. The direction $F_V$ of the divided force is the direction for the shorter distance between the diagonal roller $\mathbf{50}_8$ and the driving roller $\mathbf{16}_8$ and by this force, the conveyor belt $\mathbf{12}_8$ is given a force to move skiddingly in the direction of a shorter distance between the diagonal roller $\mathbf{50}_8$ and the driving roller $\mathbf{16}_8$. That is, the conveyor belt $\mathbf{12}_8$ skids to the end $\mathbf{50}_8$B side of the diagonal roller $\mathbf{50}_8$.

That is, it is possible to control the direction of skid of the conveyor belt $\mathbf{12}_8$ by providing the diagonal roller $\mathbf{50}_8$ which is not parallel to the driving roller $\mathbf{16}_8$.

If the direction of skid of the conveyor belt can be controlled, a single piece of the regulation belt $\mathbf{46}_8$ which controls progress of the skid is able to create its effect. That is, this is achieved when the belt $\mathbf{46}_8$ is provided only at the inside of the conveyor belt edge which has a long distance between the diagonal roller $\mathbf{50}_8$ and the driving roller $\mathbf{16}_8$.

That is, the conveyor belt $\mathbf{12}_8$ skids to the side with a shorter distance between the diagonal roller $\mathbf{50}_8$ and the driving roller $\mathbf{16}_8$ according to the diagonal roller $\mathbf{50}_8$. However, if the conveyor belt $\mathbf{12}_8$ moved skiddingly by a certain amount, the regulation belt $\mathbf{46}_8$ slides to the end surface of the driven roller $\mathbf{17}_8$ and the skid of the conveyor belt is stopped at a position where the skid moving force of the conveyor belt $\mathbf{12}_8$ is balanced with the rubber repulsive force of the regulation belt $\mathbf{46}_8$. Once both forces are balanced each other, the conveyor belt $\mathbf{12}_8$ continuously moves in this balanced state.

Figure 27:
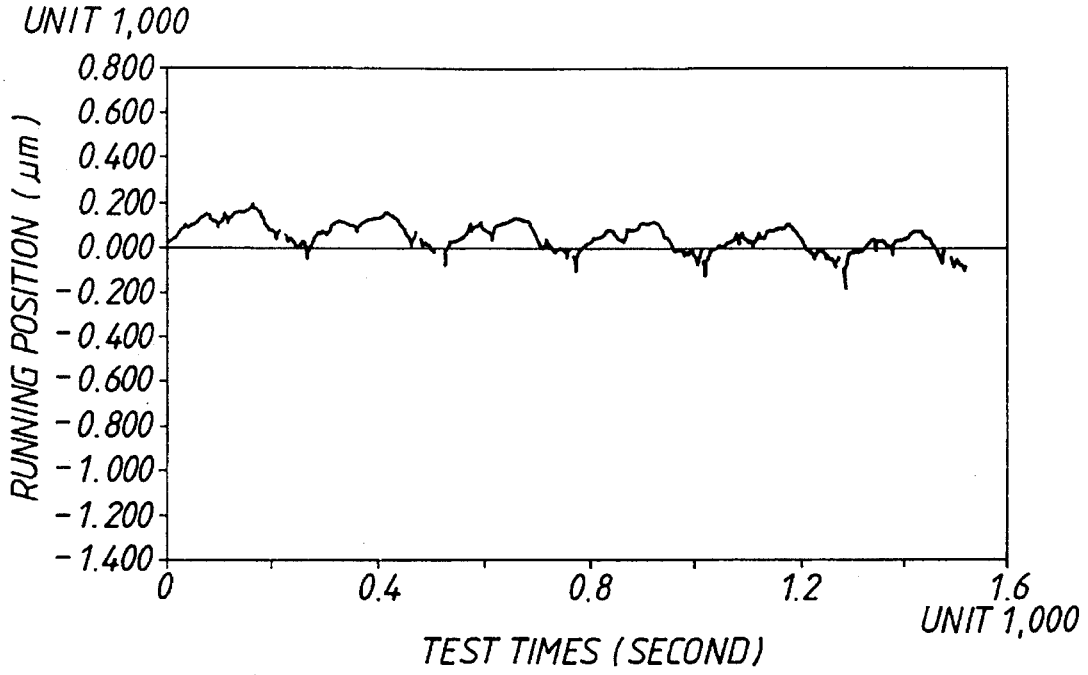
FIG. 27 is a graph showing the state of skid movement of the conveyor belt when the construction of the eighth embodiment is not adopted.
Figure 28:
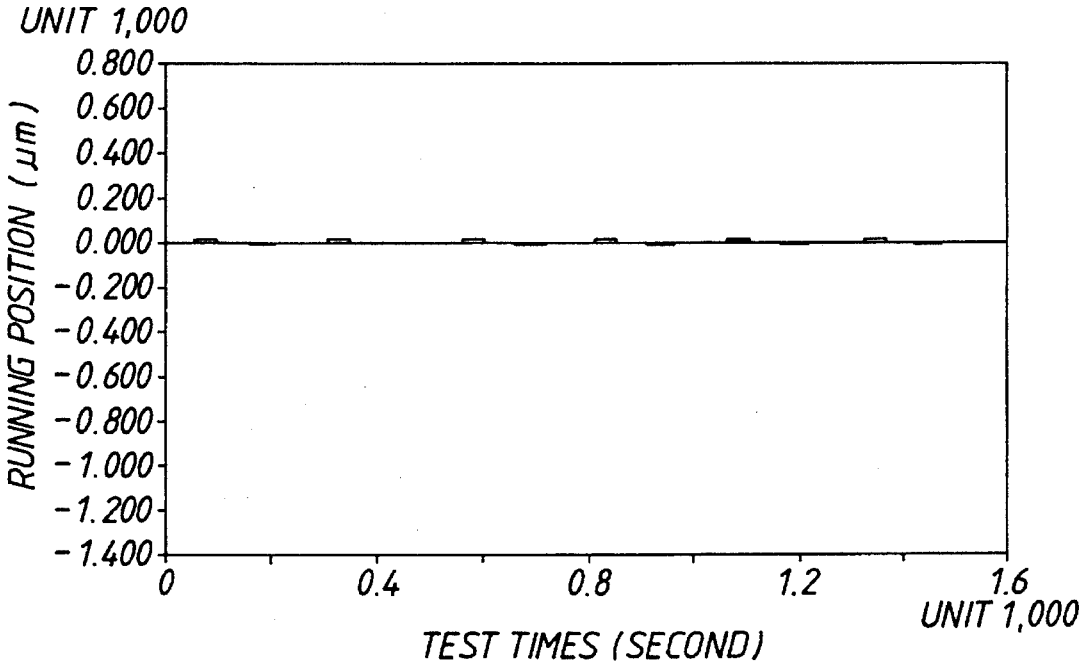
FIG. 28 is a graph showing the state of skid movement of the conveyor belt when the construction of the eighth embodiment is adopted.

FIG. 27 shows the test result of the skid of the conveyor belt when no measures described above was taken and FIG. 28 shows the test result when the measures described above were taken.

As the result of this test, "Test Times (Sec.)" showing the running times of the conveyor belt were plotted on the axis of abscissas and "Running Positions (μm)" showing the amounts of the skids of the conveyor belt were plotted on the axis of ordinates.

Therefore, the skid of the conveyor belt without taking no measure is large and the color shift of the images on the image receiving medium 8 tends to occur in the direction perpendicular to the moving direction of the conveyor belt $\mathbf{12}_8$. However, the skid of the conveyor belt is very small when it was moved with the diagonal roller $\mathbf{50}_8$ and the regulation belt $\mathbf{46}_8$ provided and it can be seen that the conveyor belt $\mathbf{12}_8$ was running in the stable state scarcely causing the color shift on the images on the image receiving medium 8 in the direction perpendicular to the moving direction of the conveyor belt 8.

In this eighth embodiment, the diagonal roller $\mathbf{50}_8$ was arranged at the loose side of the conveyor belt $\mathbf{12}_8$. However, the effect of the diagonal roller $\mathbf{50}_8$ does not change even when the diagonal roller $\mathbf{50}_8$ is arranged at the tension side of the conveyor belt if a space is available.

Further, it is not necessary to have the diagonal roller $\mathbf{50}_8$ act from the inside of the conveyor belt $\mathbf{12}_8$ and its effect does not change even when the diagonal roller $\mathbf{50}_8$ is forced to act on the surface of the conveyor belt $\mathbf{12}_8$.

Further, the end surface of the driven roller $\mathbf{17}_8$ has been explained to be the surface contacting the regulation belt $\mathbf{46}_8$ in this eighth embodiment. However, the end surface of the driving roller $\mathbf{16}_8$ may be used as the skid control surface or when a roller having an original skid control surface is provided separately, its effect does not change at all.

As described above, the skid of the conveyor belt $\mathbf{12}_8$ can be controlled by a system in very simple construction.

Next, a conveying means $\mathbf{200}_9$ in the ninth embodiment will be described with reference to FIGS. 29 to 34.

Figure 29:
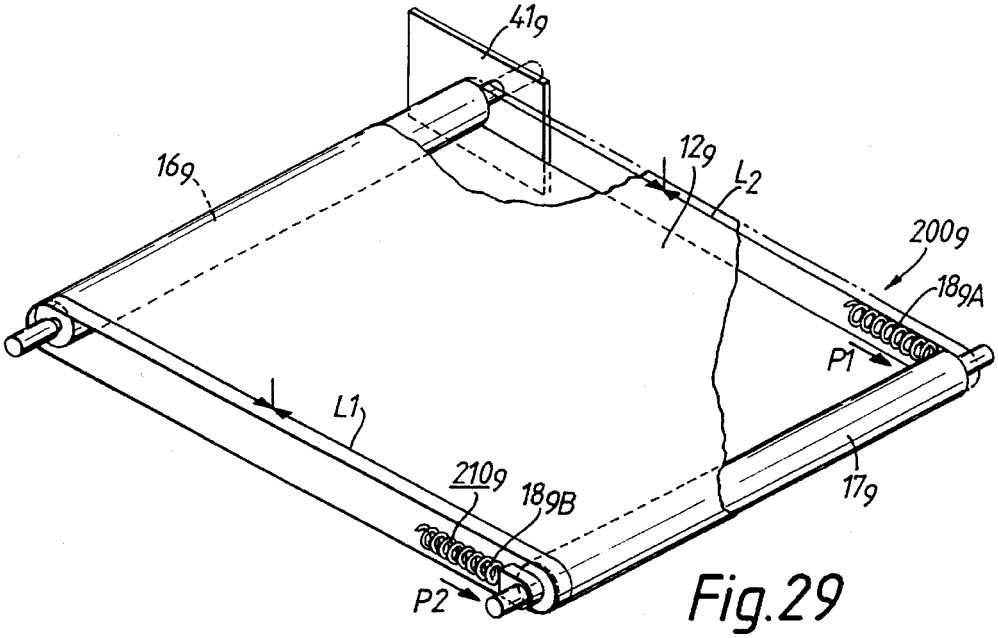
FIG. 29 is a perspective view showing the ninth embodiment of the present invention less a part of the conveying means which is its essential part.

As illustrated in FIG. 29, the conveying means $\mathbf{200}_9$ is in the construction of L1>L2 when the peripheral lengths of both edges of an endless conveyor belt $\mathbf{12}_9$ put over the driving roller $\mathbf{16}_9$ and the driven roller $\mathbf{17}_9$ are L1 and L2.

As a means to give a tension to the conveyor belt $\mathbf{12}_9$, a tensioning mechanism $\mathbf{210}_9$ is provided, which is composed of a first and a second compression springs $\mathbf{18}_9$A and $\mathbf{18}_9$B as a first and a second tensioning members, respectively. That is, the first compression spring $\mathbf{18}_9$A having a strong pressure P1 is arranged at the L2 side of a short peripheral length of the conveyor belt $\mathbf{12}_9$ and the second compression spring $\mathbf{18}_9$B having a weak pressure P2 (PI>P2) is arranged at the L1 side of the long peripheral length.

As described in the sixth embodiment, as a result of this construction, the conveyor belt $\mathbf{12}_9$ always skids toward the length L2 side where the compression spring $\mathbf{18}_9$A side having a strong pressure P1 is arranged.

On the other hand, a regulation plate $\mathbf{41}_9$ is provided along the edge of the conveyor belt $\mathbf{12}_9$ with the compression spring $\mathbf{18}_9$A having a strong pressure P1 at the L2 side of a short peripheral length.

The regulation plate $\mathbf{41}_9$ kept in contact with the edge of the conveyor belt $\mathbf{12}_9$ prevents the skid of the conveyor belt $\mathbf{12}_9$.

Figures 30A, 30B, 30C:
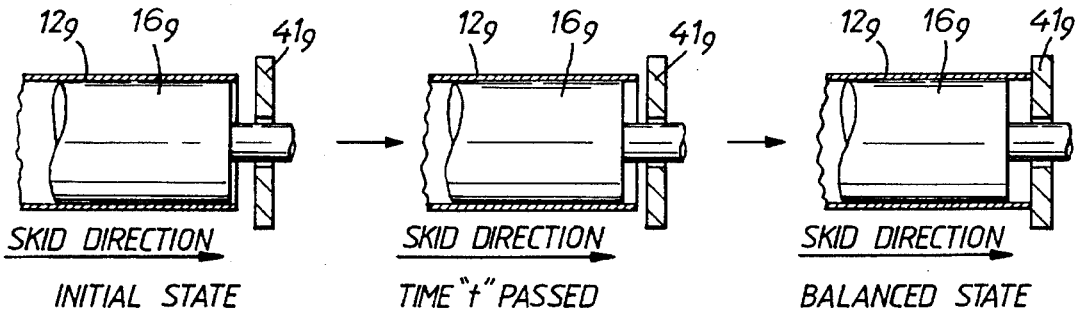
FIGS. 30A through 30C are cross-sectional views showing the positional relation of the conveyor belt and the regulation plate.

That is, as illustrated in FIGS. 30A to 30C, the regulation plate $\mathbf{41}_9$ is arranged to penetrate the rotary shaft of the driving roller $\mathbf{16}_9$. As the conveyor belt $\mathbf{12}_9$ always skids toward the first compression spring $\mathbf{18}_9$A having a strong pressure P1 at the L2 side of a short peripheral length, after elapsing "t" time shown in FIG. 30B, the edge of the conveyor belt $\mathbf{12}_9$ runs against the surface of the regulation plate $\mathbf{41}_9$, preventing the further movement of the conveyor belt $\mathbf{12}_9$ and the conveyor belt $\mathbf{12}_9$ is kept in the balanced state.

Figure 31:
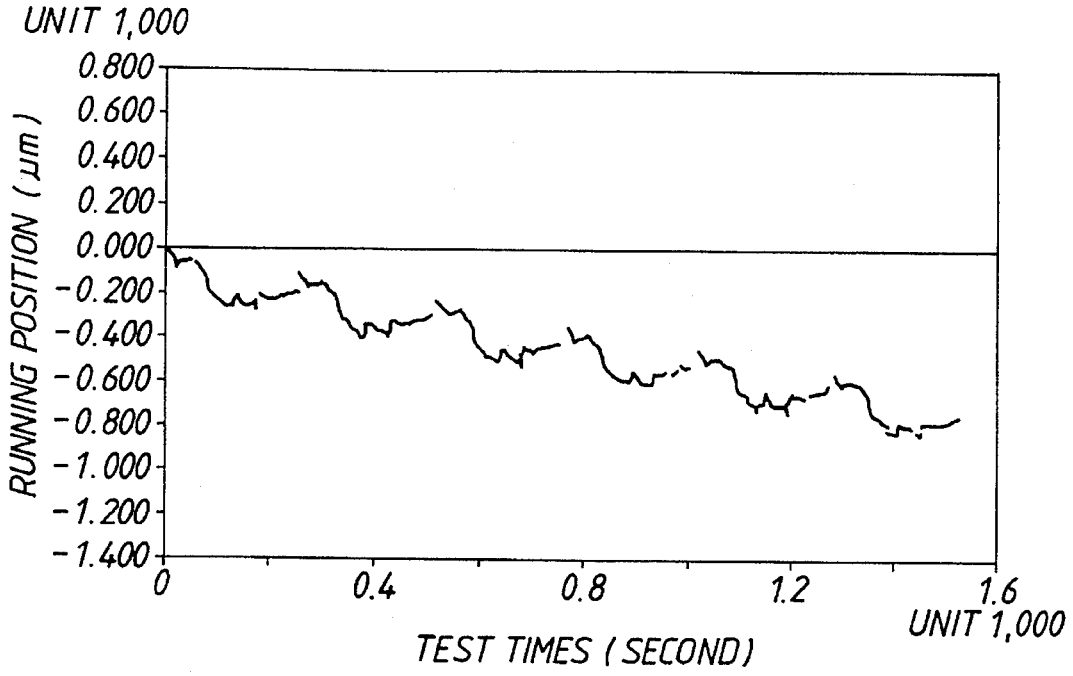
FIG. 31 is a graph showing the state of skid movement of the conveyor belt when the construction of the ninth embodiment is not adopted.

FIG. 31 shows the state of skid of the conveyor belt when it was run without the belt mounting and pressure setting made as described above and FIG. 32 shows the same when the conveyor belt was run with the belt mounted and pressure setting made as described above. As the results of this test, "Test Times (Sec.)" showing the running time of the conveyor belt is plotted on the axis of abscissas and "Running Positions (μm)" showing amount of skid of the belt is plotted on the axis of ordinates.

As clear from these test results, the amount of the skid of the conveyor belt is large when it was run without belt mounting and pressure setting made as described above and the color shift of the images on the image receiving medium 8 tends to occur in the direction perpendicular to the moving direction of the conveyor belt $\mathbf{12}_9$. However, it can be seen that it is very small when the belt was run with the belt mounting and pressure setting made as described and the conveyor belt was in the stable running state with scarcely causing the color shift of the image on the image receiving medium 8 in the direction perpendicular to the moving direction of the conveyor belt $\mathbf{12}_9$.

Figure 32:
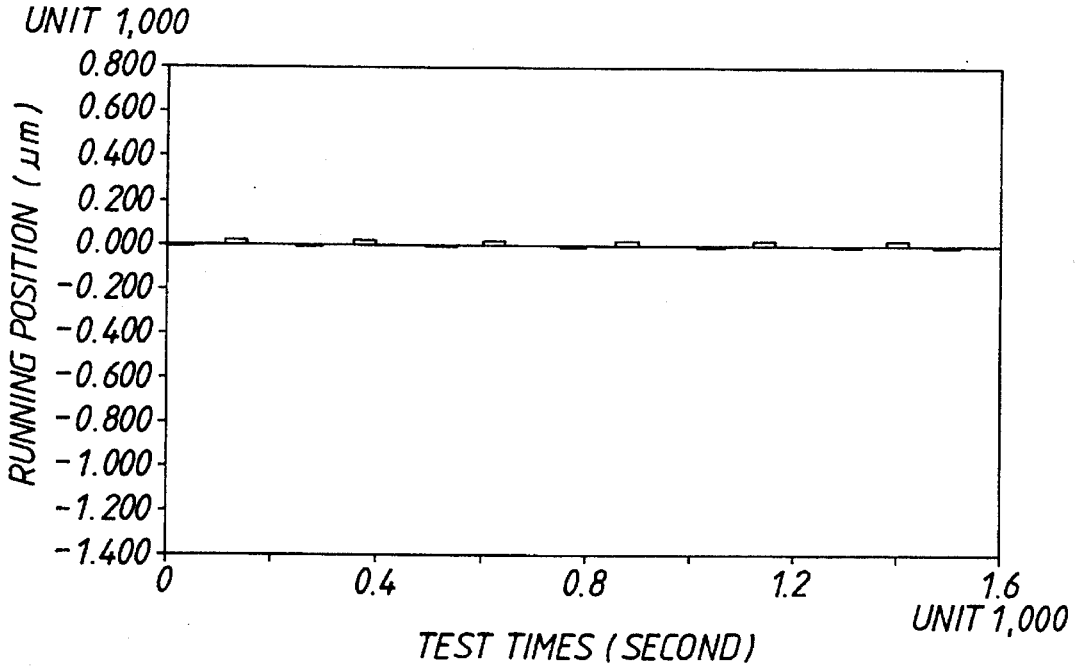
FIG. 32 is a graph showing the state of skid movement of the conveyor belt when the construction of the ninth embodiment is adopted.

The test results shown in FIG. 31 and 32 are only one example. Further statistical tests conducted revealed that the same results are obtainable according to the construction of the conveying means in this ninth embodiment if a difference in peripheral lengths of both side edges of the belts is suppressed to 1.5 mm and a difference of pressures applied is suppressed to 0.8 kg. As for accuracy of the conveyor belt, ±0.01 mm for length and ±50 g were so far demanded and therefore, when this construction is used, it is possible to effectively control and restrain the direction of skid without demanding high accuracy for the conveyor belt.

Figure 33:
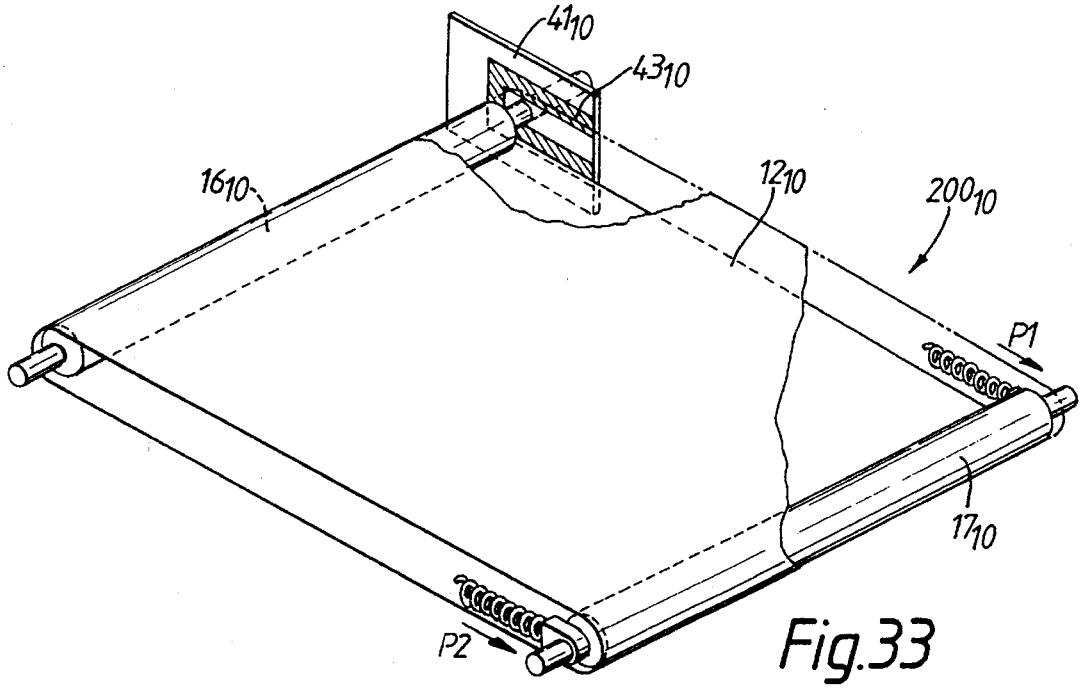
FIG. 33 is a perspective view showing the tenth embodiment of the present invention less a part of the conveying means which is its essential part.

FIG. 33 shows a conveying means $\mathbf{200}_{10}$ in the tenth embodiment. In order to make the edges of a conveyor belt $\mathbf{12}_{10}$ and a regulation plate $\mathbf{41}_{10}$ easy to slide, a surface $\mathbf{43}_{10}$ treated with a low frictional resistance is provided in their contacting area. A test result of frictional resistance of an unprocessed stainless steel plate with a PET film was 0.665. On the other hand, the coefficient of friction of an ordinary iron plate with a fluorine coating is 0.657 and therefore, it is possible to obtain an equivalent coefficient of friction from a fluorine coated iron plate even when an expensive stainless steel having a low frictional surface resistance is not used. Further, needless to say, a more low coefficient of frictional resistance can be obtained if stainless steel is coated with fluorine.

Figure 34:
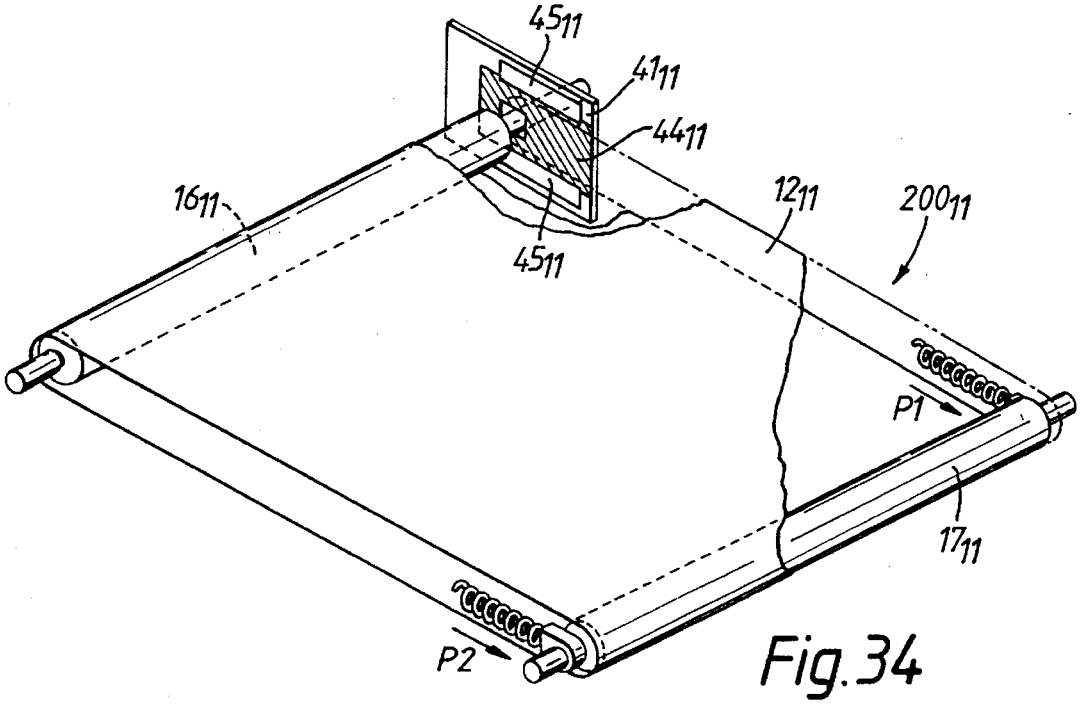
FIG. 34 is a perspective view showing the eleventh embodiment of the present invention less a part of the conveying means which is its essential part.

FIG. 34 shows a conveying means $\mathbf{200}_{11}$ in the eleventh embodiment and a sheet $\mathbf{44}_{11}$ of a low coefficient of friction is inserted between a skid control plate $\mathbf{41}_{11}$ and the edge of a conveyor belt $\mathbf{12}_{11}$. The sheet $\mathbf{44}_{11}$ of a low coefficient of friction is in somewhat large size and fixed to the skid control plate $\mathbf{41}_{11}$ by fixing adhesive tape $\mathbf{45}_{11}$. Further, the method for fixing the sheet $\mathbf{44}_{11}$ is not restricted and any other method can be used.

In the embodiments 9 to 11, regulation plates $\mathbf{41}_9$ to $\mathbf{41}_{11}$ are provided to the driving rollers $\mathbf{16}_9$ to $\mathbf{16}_{11}$ but they may be provided to the driven rollers $\mathbf{17}_9$ to $\mathbf{17}_{11}$ or along the entire edge of the conveyor belts $\mathbf{12}_9$ to $\mathbf{12}_{11}$.

As described above, in the ninth to the eleventh embodiments, an effective Control of skid of the conveyor belt can be achieved when the conveyor belt $\mathbf{12}_9$ to $\mathbf{12}_{11}$ is so arranged that the conveyor belt is running while at least a part of it is kept in contact with the regulation plate $\mathbf{41}_9$ to $\mathbf{41}_{11}$.

Next, a conveying means $\mathbf{200}_{12}$ in the twelfth embodiment will be described with reference to FIGS. 35 to 38.

Figure 35:
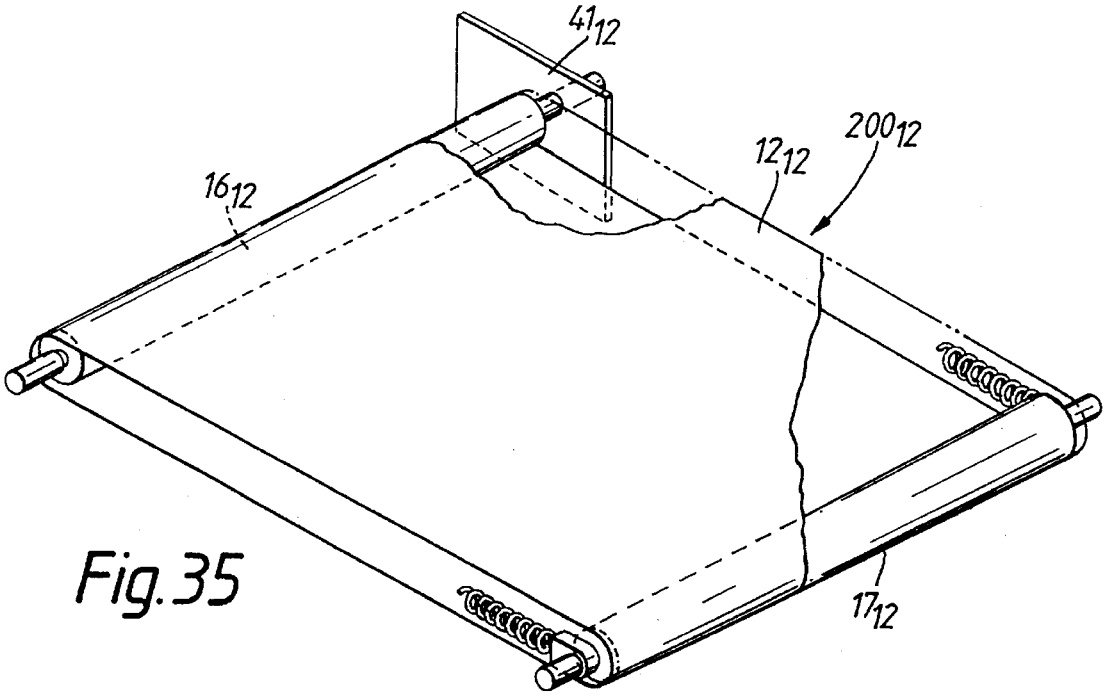
FIG. 35 is a perspective view showing the twelfth embodiment of the present invention less a part of the conveying means which is its essential part.
Figure 36:
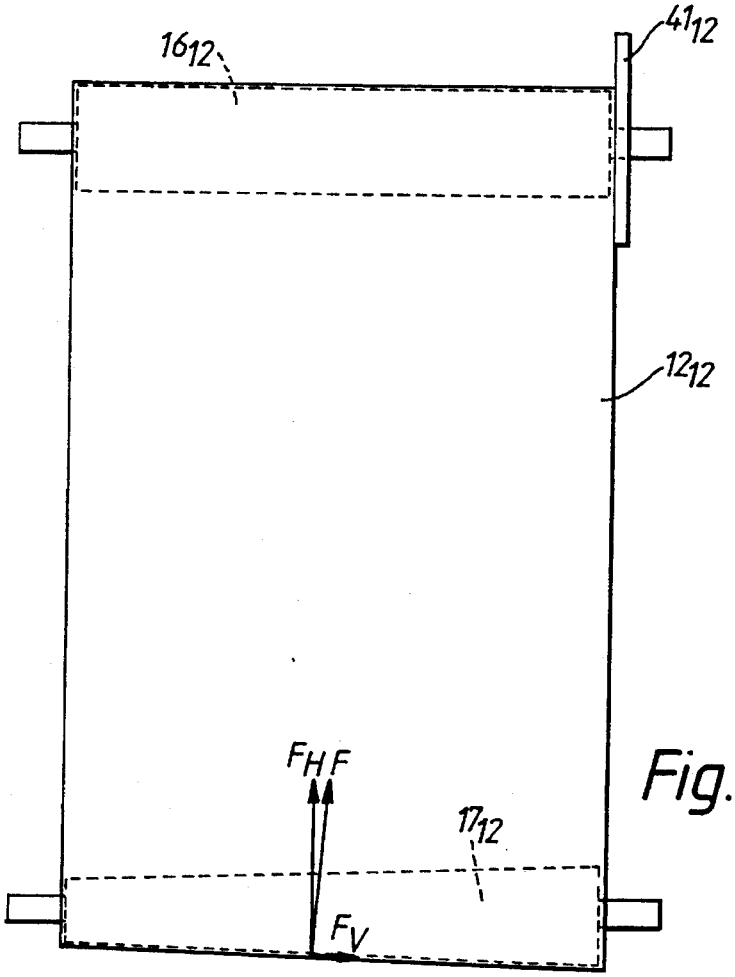
FIG. 36 is a perspective view for explaining the skid movement of the conveyor belt in the twelfth embodiment.

As illustrated in FIGS. 35 and 36, a tapered roller $\mathbf{17}_{12}$ of which diameter becomes larger gradually from one end to another end is used as a driven roller. A regulation plate $\mathbf{41}_{12}$ is provided along one edge of a driving roller $\mathbf{16}_{12}$ at the same side as the large diameter side of the tapered roller $\mathbf{17}_{12}$.

When the conveyor belt $\mathbf{12}_{12}$ is put over the driving roller $\mathbf{16}_{12}$ and the tapered roller $\mathbf{17}_{12}$, which is a driven roller, the skid will progress toward the larger diameter of the tapered roller $\mathbf{17}_{12}$ when the conveyor belt is moved as described in the seventh embodiment.

That is, as illustrated in FIG. 36, a tensile force F vertical to the inclined portion that is the tapered portion of the tapered roller $\mathbf{17}_{12}$ is first generated on the conveyor belt $\mathbf{12}_{12}$ being pulled along the tapered roller $\mathbf{17}_{12}$.

When the conveyor belt $\mathbf{12}_{12}$ is moving, this tensile force F is split into two: $F_H$ acting in the belt conveying direction and $F_V$ acting in the direction vertical to the belt conveying direction. The direction $F_V$ of the split force vertical to the belt conveying direction is the direction toward the larger diameter of the tapered roller $\mathbf{17}_{12}$ and by this force $F_V$, the conveyor belt $\mathbf{12}_{12}$ is moved one-sidedly in the direction of the larger diameter of the tapered roller $\mathbf{17}_{12}$. That is, the direction of skid of the conveyor belt $\mathbf{12}_{12}$ is controlled using the tapered roller $\mathbf{17}_{12}$ as a driven roller and the movement is regulated by the regulation plate $\mathbf{41}_{12}$ provided at the larger diameter side of the tapered roller $\mathbf{17}_{12}$.

When the skid of the conveyor belt $\mathbf{12}_{12}$ progressed to a certain amount, the regulation plate $\mathbf{41}_{12}$ and the outer edge of the conveyor belt slide and the skid is stopped at a position where the skid moving force of the conveyor belt $\mathbf{12}_{12}$ is balanced with a reactive force of the regulation plate $\mathbf{41}_{12}$. Once both forces are balanced, the conveyor belt $\mathbf{12}_{12}$ is moved in this balanced state.

Figure 37:
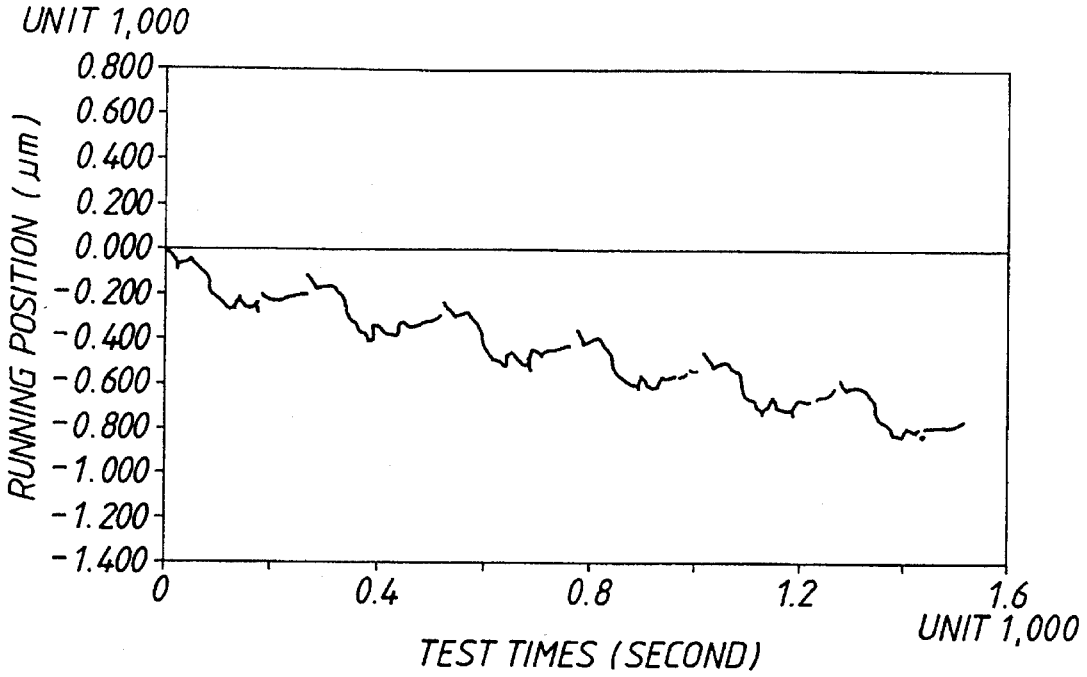
FIG. 37 is a graph showing the state of skid movement of the conveyor belt when the construction of the twelfth embodiment is not adopted.
Figure 38:
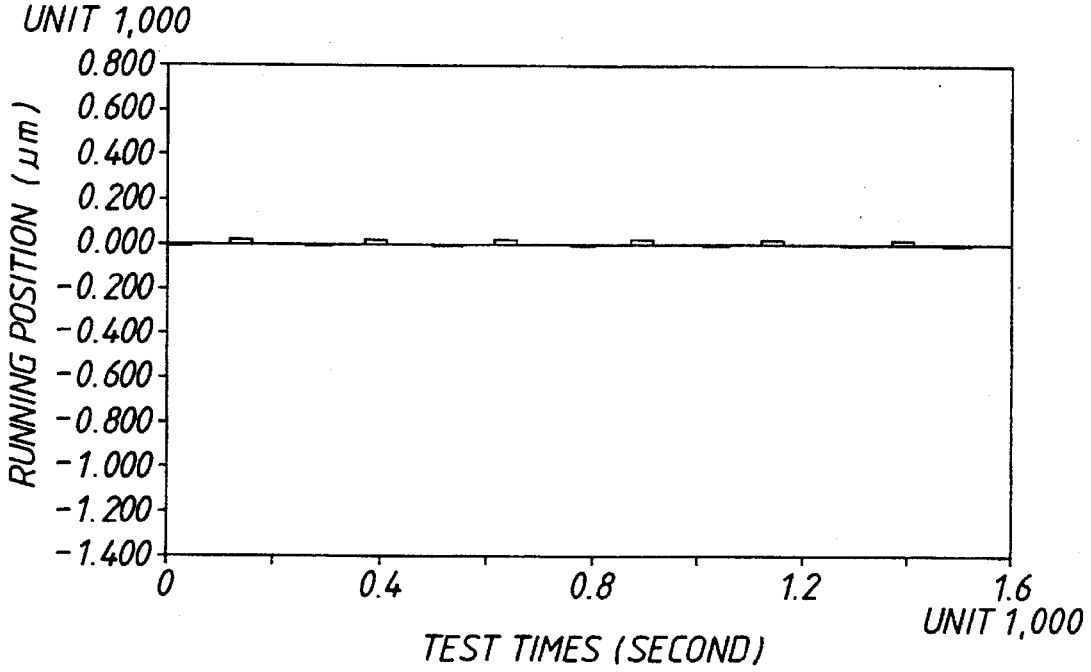
FIG. 38 is a graph showing the state of skid movement of the conveyor belt when the construction of the twelfth embodiment is adopted.

FIG. 37 shows the test result of the skid moving state when the conveyor belt was run with no measure taken and FIG. 38 shows the test result of the skid moving state when the conveyor belt was run with the tapered roller $\mathbf{17}_{12}$ and the regulation plate $\mathbf{41}_{12}$ provided.

As the results of this test, "Test Times (Sec.)" showing running times of the conveyor belt is plotted on the axis of abscissas and "Running Position (μm)" showing the amount of skid of the belt is plotted on the axis of ordinates.

As can be seen from these test results, the amount of skid of the conveyor belt is large and the color shift of the images on the image receiving medium 8 tends to occur in the direction perpendicular to the moving direction of the conveyor belt when no measure was taken. But, the amount of skid is very small when the conveyor belt $\mathbf{12}_{12}$ was run with the tapered roller $\mathbf{17}_{12}$ and the regulation plate $\mathbf{41}_{12}$ provided and the conveyor belt is in the stable running state without scarcely causing the color shift of the images on the image receiving medium 8 in the direction perpendicular to the moving direction of the conveyor belt.

The tapered roller $\mathbf{17}_{12}$ shown in the twelfth embodiment is not necessarily to be used as a driver but can be used as a third roller other than the driving roller $\mathbf{16}_{12}$ and the driven roller as its effect will not be changed. Further, it is also not necessary to have the tapered roller $\mathbf{17}_{12}$ act from the inside of the conveyor belt and its effect will not be changed even when it is acted on the surface side of the conveyor belt $\mathbf{12}_{12}$.

As described above, it is possible to efficiently suppress the skid of the conveyor belt by a system in very simple construction.

Next, a conveying means $\mathbf{200}_{13}$ in the thirteenth embodiment with reference to FIGS. 39 to 42.

Figure 39:
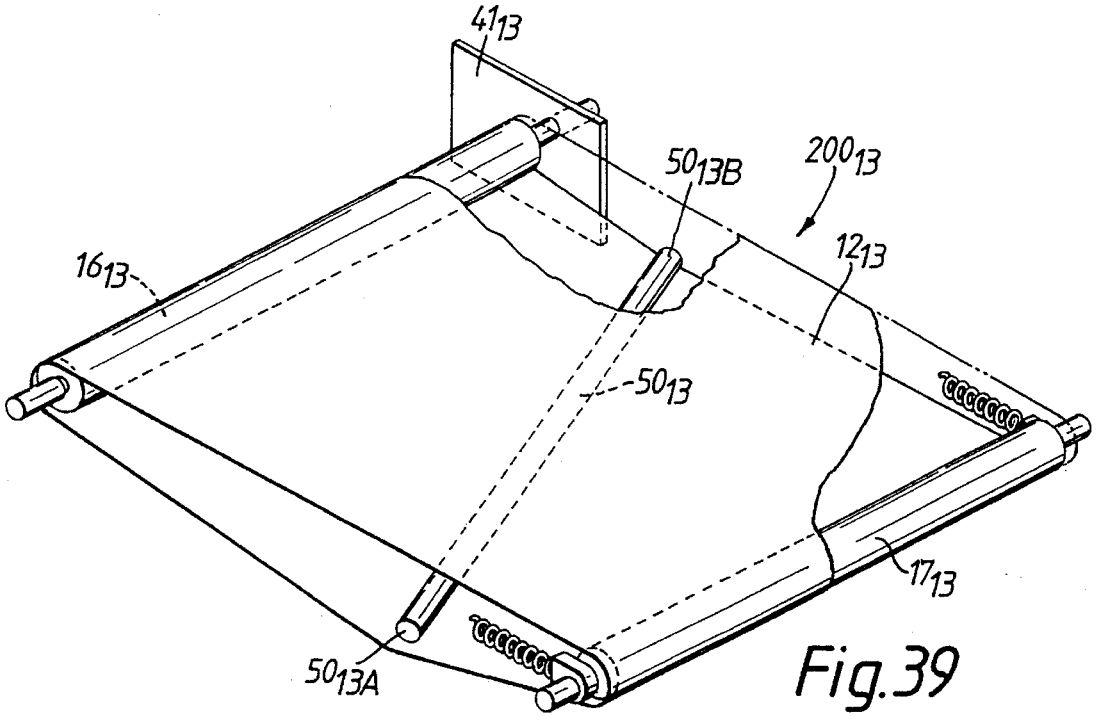
FIG. 39 is a perspective view showing the thirteenth embodiment less a part of the conveying means which is its essential part.
Figure 40:
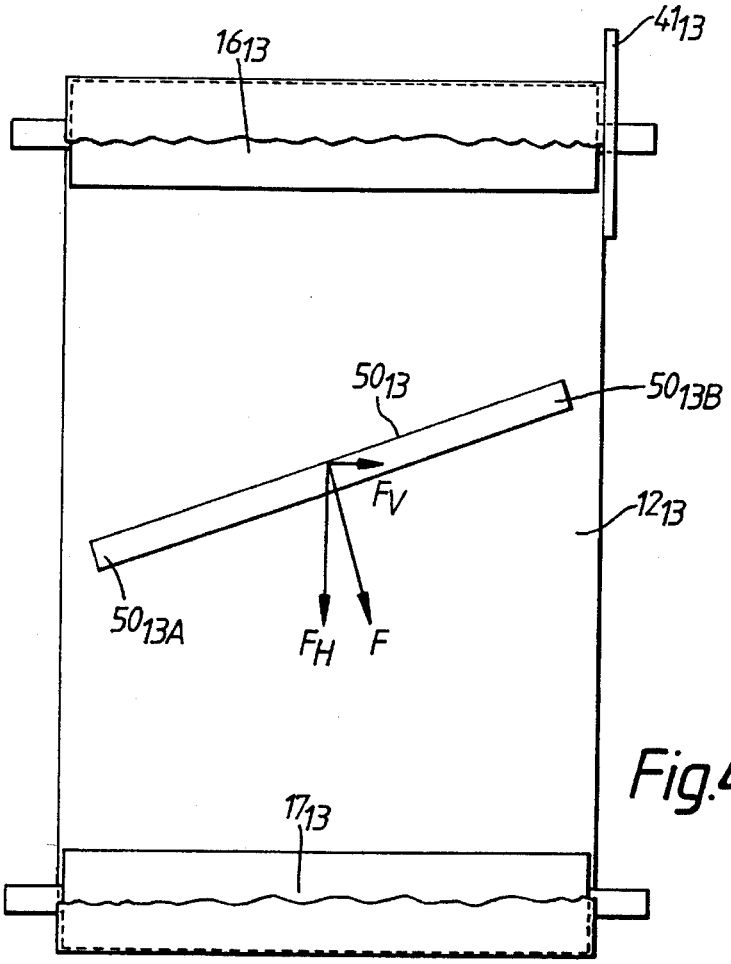
FIG. 40 is a perspective view for explaining the skid movement of the conveyor belt in the thirteenth embodiment.

As illustrated in FIGS. 39 and 40, there is a diagonal roller $\mathbf{50}_{13}$ provided between a parallelly arranged driving roller $\mathbf{16}_{13}$ and a driven roller $\mathbf{17}_{13}$ not parallelly but diagonally to these rollers $\mathbf{16}_{13}$ and $\mathbf{17}_{13}$. That is, the diagonal roller is so arranged that one end $\mathbf{50}_{13}$A of the diagonal roller $\mathbf{50}_{13}$A is close to the driven roller $\mathbf{17}_{13}$ side and another end $\mathbf{50}_{13}$B is close to the driving roller $\mathbf{16}_{13}$. Furthermore, this diagonal roller $\mathbf{50}_{13}$ is arranged at a position somewhat below the plane surface connecting the driving roller $\mathbf{16}_{13}$ and the driven roller $\mathbf{17}_{13}$ and functions as a skid control roller. The conveyor belt $\mathbf{12}_{13}$ is put over the driving roller $\mathbf{16}_{13}$, the diagonal roller $\mathbf{50}_{13}$ and the driven roller $\mathbf{17}_{13}$. On the other hand, a regulation plate $41_{13}$ is provided along one side edge of the conveyor belt where a distance between the diagonal roller $50_{13}$ and the driving roller $16_{13}$ is short. The regulation plate $41_{13}$ is in the construction as illustrated in FIGS. 30A to 30C.

In the construction described above, the conveyor belt $12_{13}$ moves one-sidedly toward the end of the diagonal roller $50_{13}$ of which distance to the driving roller $16_{13}$ is short. That is, the conveyor belt $12_{13}$ moves one-sidedly toward the end $50_{13}$B of the diagonal roller $50_{13}$.

In this case, as illustrated in FIG. 40, the conveyor belt $12_{13}$ is first twisted by the diagonal roller $50_{13}$ and a tensile force F is generated in the direction perpendicular to the central axis of rotation of the diagonal roller $50_{13}$. In actual operation, this force F is split and acts in the belt conveying direction FH and the direction $F_V$ vertical to the belt conveying direction. The direction $F_V$ of a force split in the direction vertical to the belt conveying direction is a direction of a short distance of the diagonal roller $50_{13}$ to the driving roller $16_{13}$ and by this force the conveyor belt $12_{13}$ is given a force to move one-sidedly in the direction of a short distance of the diagonal roller $50_{13}$ to the driving roller $16_{13}$. That is, the conveyor belt $12_{13}$ moves skiddingly to the end $50_{13}$B side of the diagonal roller $50_{13}$.

That is, it is possible to control the skid direction of the conveyor belt $12_{13}$ by providing the diagonal roller $50_{13}$ which is not parallel to the driving roller $16_{13}$ and to control the further skid by the regulation plate $41_{13}$.

In other words, the conveyor belt $12_{13}$ moves skiddingly to the short distance side between the diagonal roller $50_{13}$ and the driving roller $16_{13}$ following the diagonal roller $50_{13}$ but when the conveyor belt $12_{13}$ moves skiddingly to a certain distance, the outer peripheral edge of the conveyor belt slides on the regulation plate $41_{13}$ and the skid of the belt is stopped at a position where the skidding force of the conveyor belt $12_{13}$ is balanced with the reaction of the regulation plate $41_{13}$. Once both forces are balanced, the conveyor belt $12_{13}$ moves continuously while kept in this balanced state.

Figure 41:
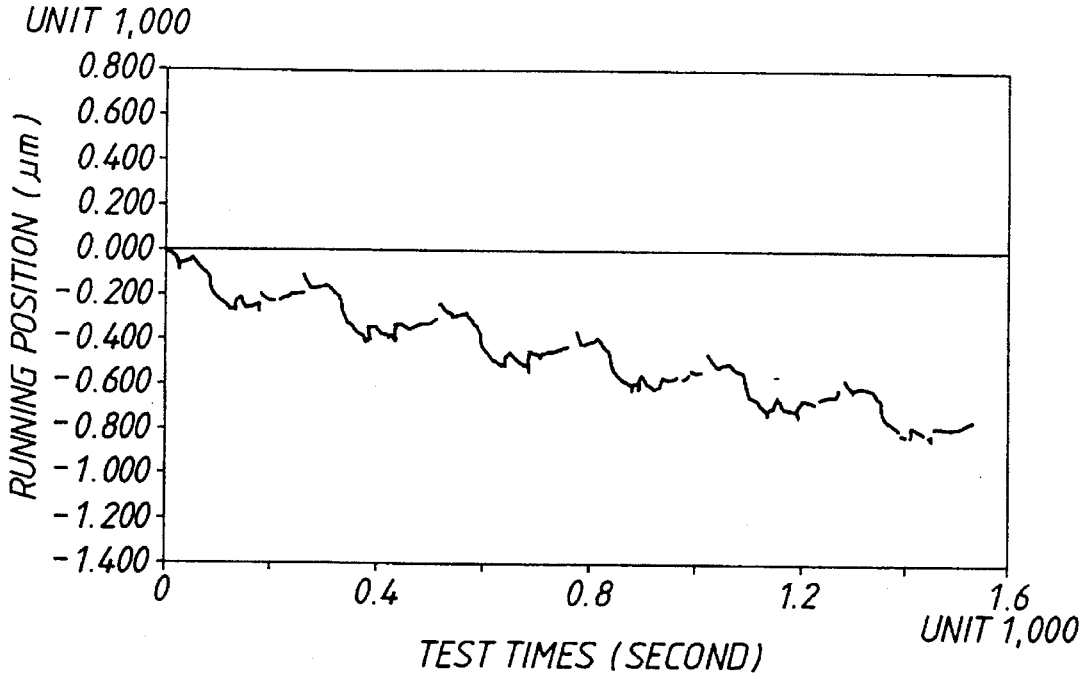
FIG. 41 is a graph showing the state of skid movement of the conveyor belt when the construction of the thirteenth embodiment is not adopted.
Figure 42:
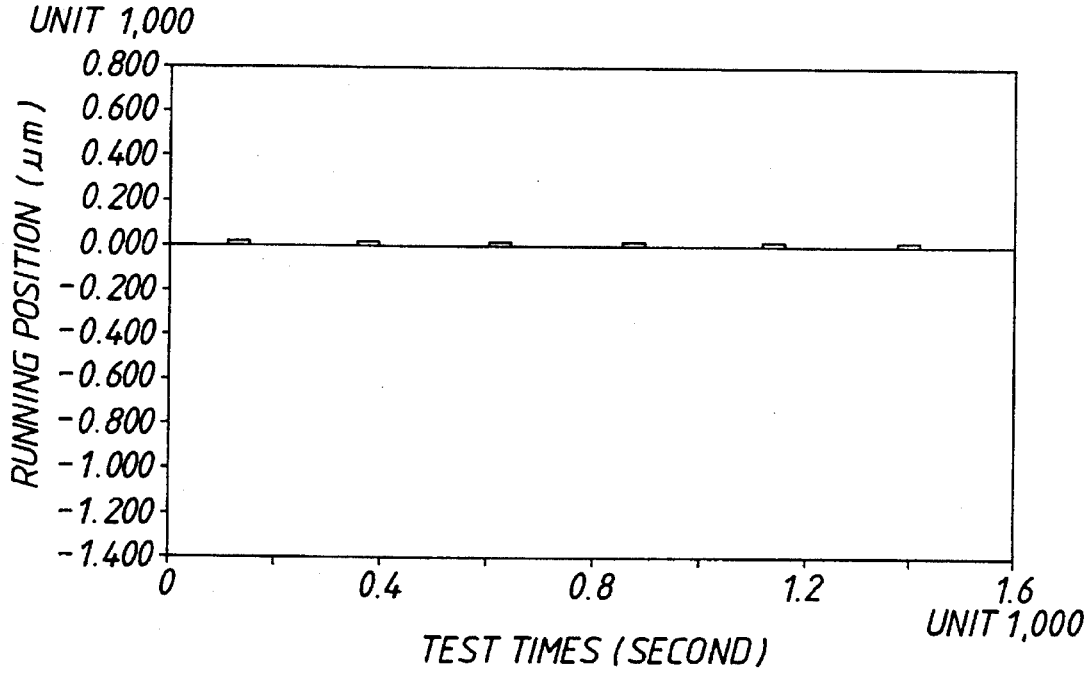
FIG. 42 is a graph showing the state of skid movement of the conveyor belt when the construction of the thirteenth embodiment is adopted.

FIG. 41 shows the test result of the skid of the conveyor belt when the measures described above were not taken and FIG. 42 shows the same with the measures described above taken.

As the results of this test, "Test Time (Sec.)" showing the belt running times is plotted on the axis of abscissas and "Running Positions (μm)" showing amount of skid of the belt is plotted on the axis of ordinates.

Therefore, skid of the conveyor belt arranged without taking any measure is large and the color shift of the images tends to occur on the images on the image receiving medium 8 in the direction perpendicular to the moving direction of the conveyor belt $12_{13}$. However, the skid of the conveyor belt $12_{13}$ is very small when the diagonal roller $50_{13}$ and the regulation plate $41_{13}$ are arranged and it is seen that the conveyor belt $12_{13}$ is in the stable running state scarcely causing the color shift of the image on the image receiving medium 8 in the direction perpendicular to the moving direction of the conveyor belt.

In the thirteenth embodiment, the diagonal roller $50_{13}$ was arranged at the loose side of the conveyor belt $12_{13}$. However, the effect of the diagonal roller $50_{13}$ will not be changed even when it is arranged at the stretched side of the conveyor belt $12_{13}$ if a space is available.

Further, it is not necessary to have the diagonal roller $50_{13}$ act from the inside of the conveyor belt $12_{13}$ and the effect of the diagonal roller $50_{13}$ does not change when the diagonal roller $50_{13}$ is forced to act on the surface side of the conveyor belt $12_{13}$.

As described above, it is possible to suppress the skid of the conveyor belt $12_{13}$ by a system in very simple construction.

Next, a conveying means $200_{14}$ in the fourteenth embodiment with reference to FIGS. 43 to 50.

Here, only those portions differing from the construction illustrated in FIG. 1 are referred to in the description of the first embodiment will be described and the explanation of the same portions will be omitted.

Figure 43:
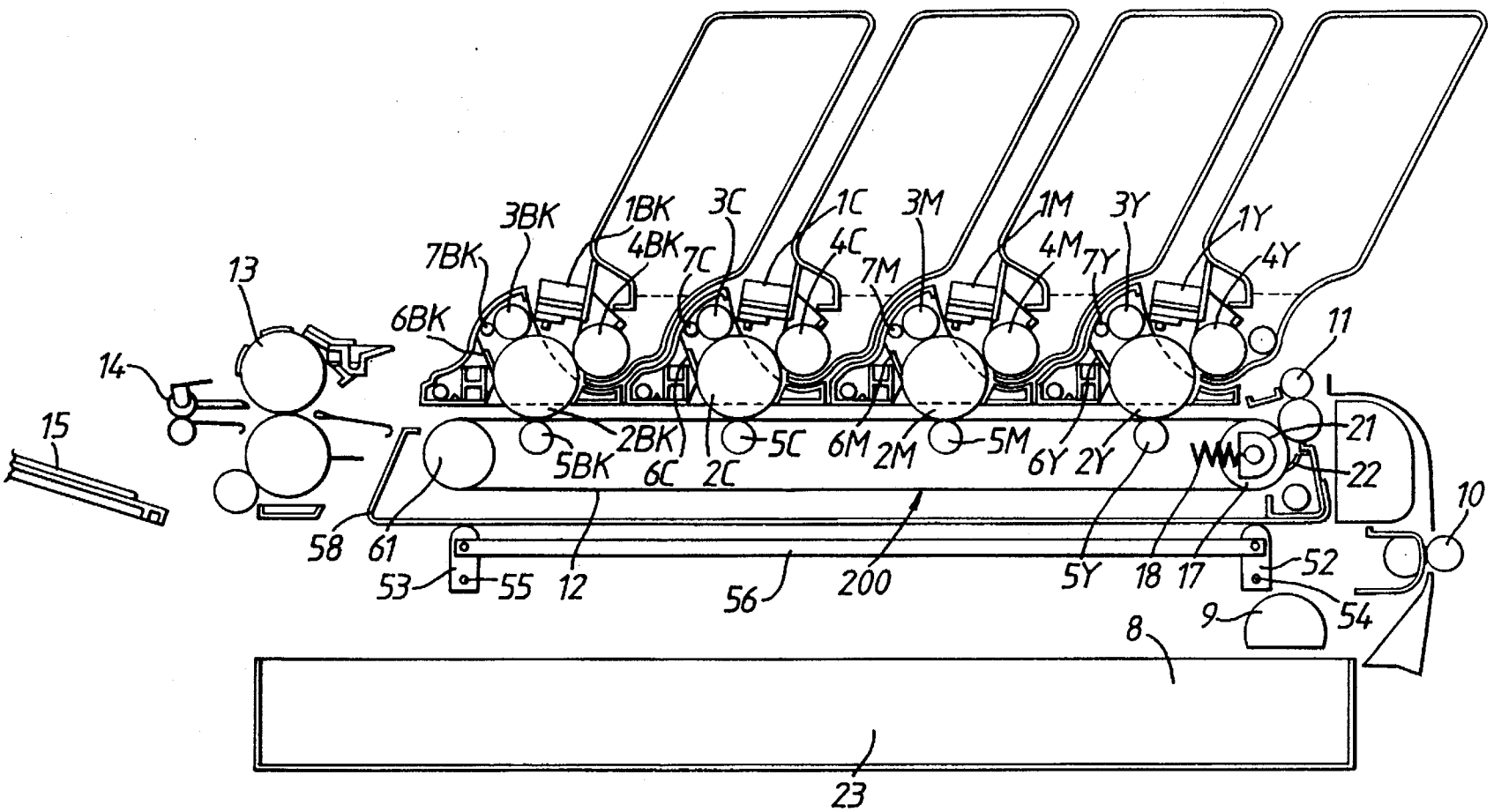
FIG. 43 is an outline diagram of full-color image forming apparatus showing the fourteenth embodiment of the present invention.

FIGS. 43 and 44 show the state where a belt unit frame 58 is lifted by a lifting lever in the image forming operation so that the photosensitive drums 2Y, 2M, 2C and 2BK and the conveyor belt 12 are brought in contact with each other in the prescribed state.

Figure 45:
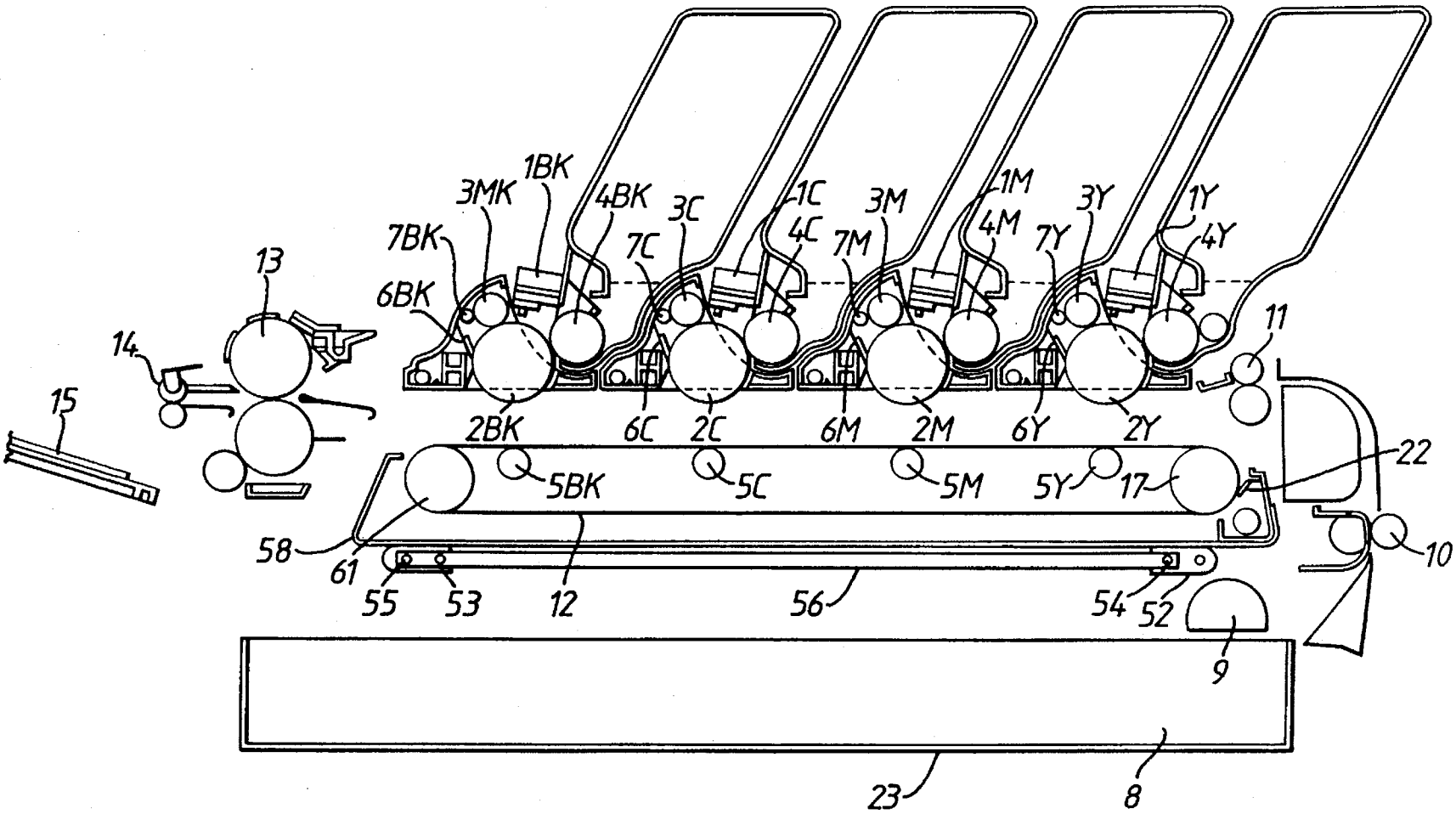
FIG. 45 is an outline diagram showing the state of the conveyor belt unit separated from the photosensitive drums shown in FIG. 44.

FIG. 45 shows the state where the lifting lever was lowered and the conveyor belt 12 was separated from the photosensitive drums 2Y, 2M, 2C and 2BK. Under this state where the conveyor belt 12 is separated from the photosensitive drums 2Y, 2M, 2C and 2BK, the conveyor belt unit including the conveyor belt 12 can be pulled out of the body of the image forming apparatus to the outside. If the image receiving medium 8 is jammed in the apparatus, the belt unit including the conveyor belt 12 is pulled out of the body of the apparatus to the outside when taking out this jammed image receiving medium 8.

The belt unit is supported by a first lifting lever 52 provided at the front and rear sides of the paper supply side and a second lifting lever 53 provided at the front and rear sides of the paper exit side, total four levers. The first lifting levers 52 provided at the front and the rear sides illustrated in the figure are connected by a first rotating shaft 54 and rotate at the same angle. Further, the second lifting levers 53 at the front and the rear sides shown in the figure are connected by the second rotating shaft 55 and rotate at the same angle. Further, the first lifting levers 52 and the second lifting levers 53 are connected mutually at the front side and the rear side, respectively. The first rotating shaft 54 is provided with a handle 57 at its end. A first rotating shaft 54 and a second rotating shaft 55 are supported in the rotatable state on the body of the apparatus. When the handle 57 is rotated, the first rotating shaft 54 rotates and thus, the first lifting levers 52 at the front and the rear sides are rotated. When the first lifting lever 52 is rotated, the connecting link 56 is pulled in the rotating direction, and the second lifting lever 53 is rotated. The belt unit frame 58 is lifted to the photosensitive drums 2Y, 2M, 2C and 2BK side when the first and the second lifting levers 52 and 53 are rotated.

In the image forming, the image forming apparatus is kept in the state where the handle 57 is rotated, that is, the belt unit frame 58 is lifted. The lifting levers have been designed to have lengths so that the conveyor belt 12 and the photosensitive drums 2Y, 2M, 2C and 2BK are maintained in the prescribed state where they are kept in contact with each other. In processing the jammed image receiving medium 8, when the handle 57 is rotated in the reverse direction to make the lifting levers level, the belt unit frame 58 goes down and the photosensitive drums 2Y, 2M, 2C and 2BK are separated from the conveyor belt 12 as illustrated in FIG. 45.

For a motor for driving the conveyor belt 12, an outer roller motor, which is in a construction that the motor body is contained in a roller and its housing is rotated, was adopted. Hereinafter, this motor will be described by referring it as a roller-in motor 61.

The conveyor belt 12 is put over a roller 61*a*, which is a rotating housing of the roller-in motor 61, and the driven roller 17, which is rotated with the movement of the conveyor belt.

First, the principle of the motor will be briefly described. FIG. 46 is a diagram showing Fleming's left hand rule and FIG. 47 is a diagram showing the principle of a DC motor.

Motors called electric motors are all in a construction to run by converting electric energy into mechanical energy and generating turning force (torque) by electromagnetic force. The most basic electromagnetic force is according to Fleming's left hand rule illustrated in FIG. 46 and when current I is flown through a conductor in length l placed in the magnetic field B, a force F acting on the conductor is obtained.

A motor is manufactured on the basis of this principle and a DC motor illustrated in FIG. 47 rotates according to the principle described below. When a current is applied to a coil in the magnetic field in the direction shown in the figure, a downward force acts on a conductor x and an upward force acts on a conductor y and these conductors x, y are rotated clockwise. However, if this state is left as it is, the directions of the downward and upward forces are reversed when the conductors x, y are rotated to the opposite side and they are not rotated. So, when the conductors x, y are moved from under the N pole to the S pole and from under the S pole to the N pole, the current direction is reversed by a rectifier mechanism comprising commutator segments connected to the rotating conductors x, y and fixed brushes which are slide contacting the commutator segments, thus generating turning forces in the same direction. Actual motors are in a construction that a number of conductors and commutator segments are provided in order to increase the space utilization rate and to make generation of torque smooth and conductors are contained in the grooves of cores.

Figure 48:
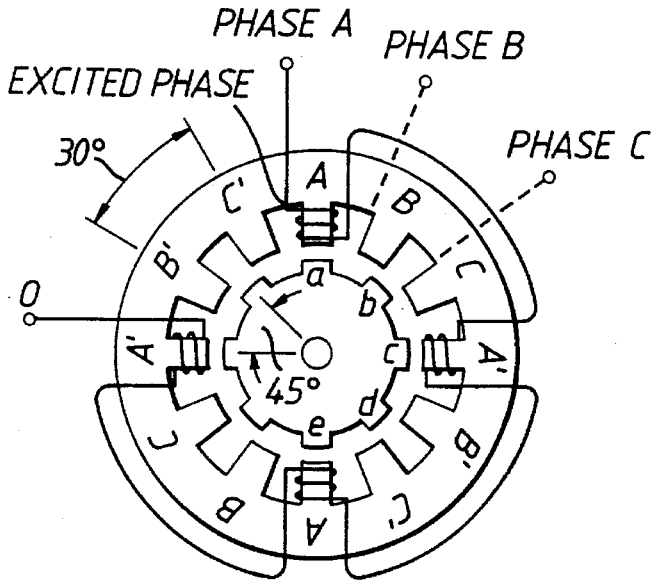
FIG. 48 is a diagram showing the principal construction of a stepping motor.
Figure 49:
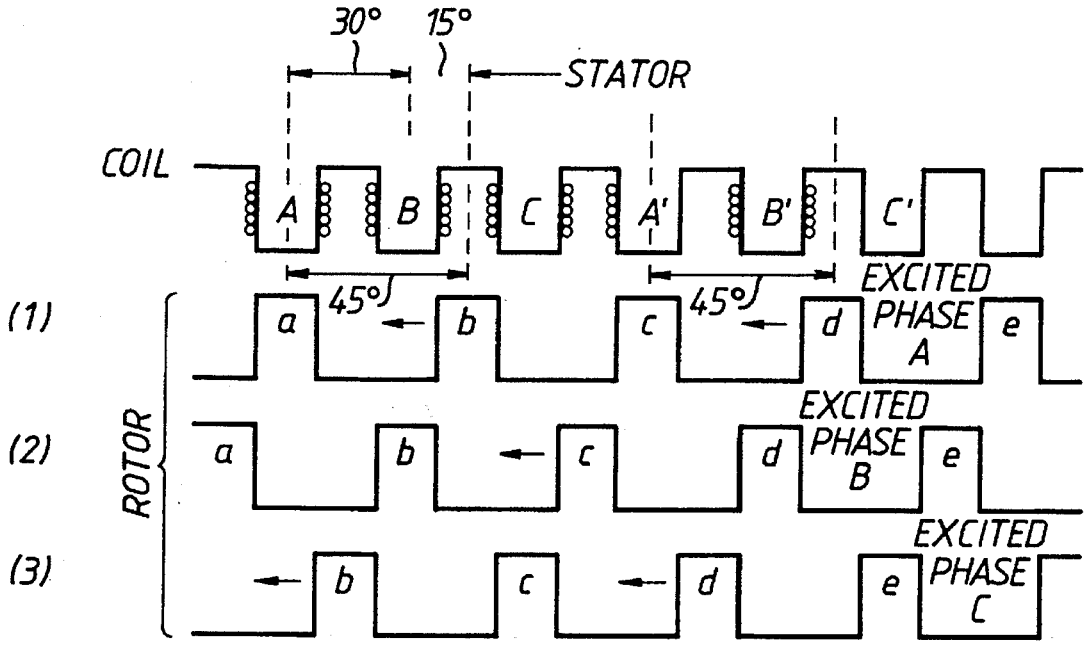
FIG. 49 is an explanatory diagram showing the principle of operation of the stepping motor shown in FIG. 48.

FIG. 48 shows a diagram of the principle of construction of a stepping motor used in this fourteenth embodiment and FIG. 49 shows a diagram of the principle of operation of the stepping motor. The stepping motor is a motor that rotates one step at a time at a fixed angle to input pulse and is also called a pulse motor or a step motor. In FIG. 49, if the phase A only is excited, magnetic flux becomes maximum when the rotor tooth comes under the tooth of the winding of phase A and the motor stops at the position (1). When the excitation is switched to the phase B successively, a force acts in the arrow direction and the motor stops at the position (2) and when switched to the phase C, the motor proceeds to the position (3). Thus, the motor rotates a fixed step at a time (the basic step) when the excitation of the phase A/B/C is repeated.

In this fourteenth embodiment, the roller-in motor which is composed of this stepping motor is used. To be concrete, this motor is in such a construction that the outer rotor is rotated with the motor shaft fixed. This motor is generally called as an outer rotor type motor. When this outer rotor type motor is used, the outer rotor can be used as a roller. Further, the cross sectional area becomes small as the motor body is housed in the roller but the depth of the motor can be extended to the roller length. Therefore, a more cross sectional area can be obtained by an area corresponding to the depth although magnetic flux of an inner magnet per unit becomes small. It is generally said that in order to get an increased torque that is obtained when the outer diameter of a motor is made double by extending the depth of the motor, three times of the depth is needed. In the case of this embodiment, the outer rotor type motor was in a shape of ϕ50×30 mm. As the driving roller is ϕ25×290 mm, the cross sectional area is ¼ and the depth is about 10 times. Now, to make it easy to think, when judging based on the sectional area of the driving roller, a length of 6×30 mm is required for the depth from 2:3=4:X, X=6. That is, this means that a motor in ϕ50×300 mm and a motor in ϕ25×180 mm are able to generate the same torque. In this embodiment, from a 290 mm long driving roller, a motor in ϕ25×290 mm is able to have a torque of 1.6 times of that of a motor in ϕ25×180 mm. Thus, by housing a motor in a roller, it is possible to increase a motor torque without affecting a size of an apparatus.

Figure 50:
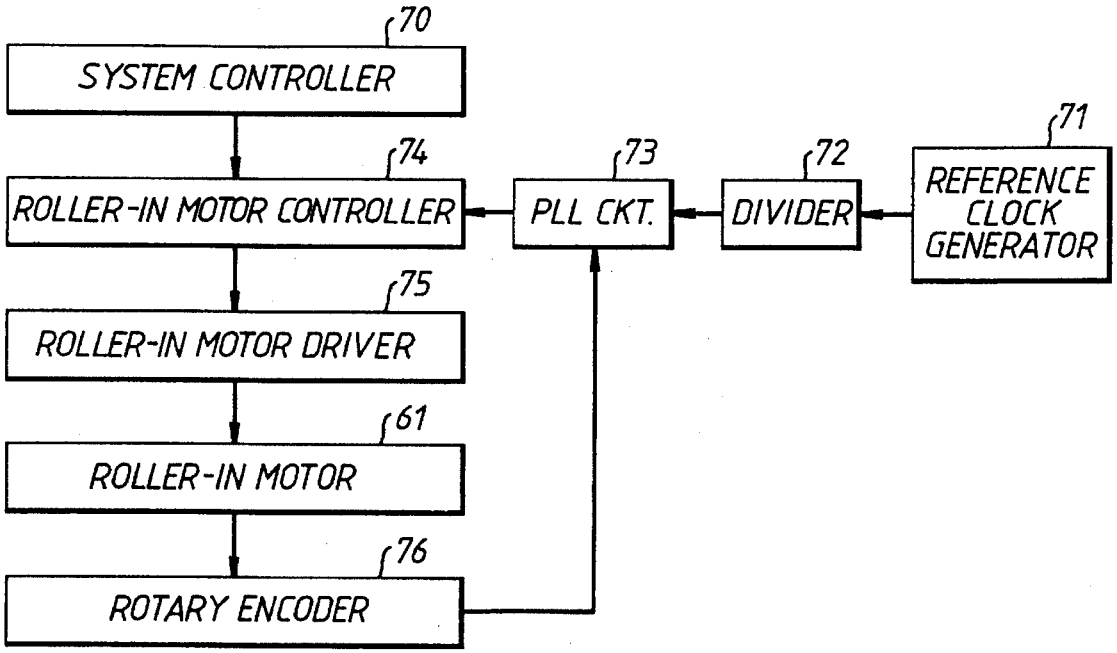
FIG. 50 is a block diagram for controlling the roller in-motor which is used in the conveyor belt unit shown in FIG. 44.

FIG. 50 shows a block diagram of the roller-in motor control. A system controller 70 is for controlling the entire apparatus. A reference clock generator 71 generates a reference clock and a divider 72 divides the reference clock from the reference clock generator 71. A PLL circuit 73 outputs driving pulses corresponding to a signal from the divider 72 and an encoder signal from the roller-in motor 61. A roller-in motor controller 74 controls the running of the roller-in motor by driving a roller-in motor driver 75 corresponding to the driving pulses from the PLL circuit 73. The divider 72 is used to generate clock widths that are easily controllable by the roller-in motor 61. A rotary encoder 76 as a rotary fluctuation detector is housed in the roller-in motor 61. The PLL control is to control driving control waveforms and output waveforms from the encoder 76 so that they agree with each other.

As described above, when an outer rotor type motor housing the motor body in the conveyor belt driving roller is used, it becomes possible to increase the motor torque without affecting the image forming apparatus. Further, differing from conventional motors, there is no occupying area at the outside of the conveyor belt and it becomes unnecessary to avoid the motor cross sectional area when processing jammed papers and there is a merit that image forming apparatus can be down sized.

According to this fourteenth embodiment, it is possible to eliminate an occupying area for an independent motor and easily increase the motor torque when roller-in type conveyor belt driving motors are adopted. Furthermore, it is not necessary to evade the conveyor belt unit largely when processing jammed papers. Thus, an image forming apparatus which does not become large in size.

What is claimed is:

1. An image forming apparatus comprising:

means for forming images on a plurality of image carriers;

a conveyor belt having a first peripheral edge and a second peripheral edge opposing the first peripheral edge for carrying an image receiving medium, the conveyor belt having a first length L1 at the first peripetal edge and a second length L2 at the second peripheral edge shorter than the first length L1;

a plurality of rollers on which the conveyor belt is mounted for moving the conveyor belt to convey the image receiving medium sequentially to the image carriers;

a tensioning means for giving a tension to the conveyor belt so as to skid the conveyor belt toward the second peripheral edge when the conveyor belt is moved by the rollers;

a regulation member for regulating the skid of the conveyor belt; and means for transferring the images from the image carriers to the image receiving medium conveyed by the conveyor belt.

2. An image forming apparatus as claimed in claim 1, wherein the tensioning means includes a first tensioning member having a first pressure P1 arranged near the second peripheral edge and a second tensioning member having a second pressure P2, weaker than the first pressure P1, arranged near the first peripheral edge.

3. An image forming apparatus comprising:

means for forming images on a plurality of image carriers;

a conveyor belt for carrying an image receiving medium;

a plurality of rollers on which the conveyor belt is mounted for moving the conveyor belt to convey the image receiving medium sequentially to the image carriers, the rollers including a tensioning roller having a contact surface non-parallel to another roller for giving a tension to the conveyor belt so as to skid the conveyor belt toward one end of the rollers when the conveyor belt is moved;

a regulation member for regulating the skid of the conveyor belt; and means for transferring the images from the image carriers to the image receiving medium conveyed by the conveyor belt.

4. An image forming apparatus as claimed in claim 3, wherein the tensioning roller includes a diagonal roller diagonally arranged between a pair of other rollers.

5. An image forming apparatus as claimed in claim 3, wherein the tensioning roller includes a tapered roller having a diameter gradually increased in a direction perpendicular to the moving direction of the conveyor belt to form a first diameter at one end thereof and a second diameter at another end thereof smaller than the first diameter.

* * * * *